US009920950B2

(12) United States Patent
Ulmanen et al.

(10) Patent No.: US 9,920,950 B2
(45) Date of Patent: Mar. 20, 2018

(54) CHILLED BEAM WITH MULTIPLE MODES

(71) Applicant: OY HALTON GROUP LTD., Helsinki (FI)

(72) Inventors: Heimo Ulmanen, Kausala (FI); Andrey V. Livchak, Bowling Green, KY (US)

(73) Assignee: OY HALTON GROUP LTD., Helsinki (FI)

( * ) Notice: Subject to any disclaimer, the term of this patent is extended or adjusted under 35 U.S.C. 154(b) by 720 days.

(21) Appl. No.: 14/384,461

(22) PCT Filed: Mar. 15, 2013

(86) PCT No.: PCT/IB2013/000771
§ 371 (c)(1),
(2) Date: Sep. 11, 2014

(87) PCT Pub. No.: WO2013/136177
PCT Pub. Date: Sep. 19, 2013

(65) Prior Publication Data

US 2015/0107802 A1 Apr. 23, 2015

Related U.S. Application Data

(60) Provisional application No. 61/611,979, filed on Mar. 16, 2012.

(51) Int. Cl.
*F24F 11/00* (2006.01)
*F24F 13/26* (2006.01)
*F24F 1/01* (2011.01)

(52) U.S. Cl.
CPC ..... *F24F 13/26* (2013.01); *F24F 1/01* (2013.01)

(58) Field of Classification Search
CPC ..... F24F 13/06; F24F 1/01; F24F 2221/14
See application file for complete search history.

(56) References Cited

U.S. PATENT DOCUMENTS 3,032,323 A * 5/1962 Church ..... F24F 1/01 165/123
3,122,201 A 2/1964 Ashley et al.
3,172,463 A 3/1965 Bowman
(Continued)

FOREIGN PATENT DOCUMENTS

AU 2010201383 A1 10/2010
CA 2685977 A1 6/2010
(Continued)

OTHER PUBLICATIONS

International Search Report and Written Opinion, dated Nov. 15, 2013, for International Application No. PCT/IB2013/000771.
(Continued)

*Primary Examiner* — Steven B McAllister
*Assistant Examiner* — Jonathan Cotov
(74) *Attorney, Agent, or Firm* — Potomac Law Group, PLLC; Mark Catan

(57) ABSTRACT

A chilled beam has separate primary and secondary inlets and plenums each or which generates separate sets of induction jets to draw air through a chilled beam heat exchanger. Various system and method embodiments are described as well as features usable in conventional active chilled beams to facilitate the use variable thermal and ventilation load applications.

24 Claims, 9 Drawing Sheets

(56) References Cited

U.S. PATENT DOCUMENTS 3,217,788 A 11/1965 Adam
3,420,439 A * 1/1969 Meckler ..... F24F 3/056 165/53
3,424,233 A * 1/1969 Meckler ..... F21V 33/0088 165/48.1
3,720,258 A 3/1973 Chandler
3,823,870 A 7/1974 Chandler
4,181,253 A 1/1980 Barlow
4,473,107 A 9/1984 Fairbrother et al.
6,079,626 A 6/2000 Hartman
6,213,867 B1 * 4/2001 Yazici ..... F24F 1/01 454/261
6,260,375 B1 * 7/2001 Kuo ..... F24F 13/072 454/234
6,370,906 B1 * 4/2002 Kuo ..... F24F 13/06 454/245
6,427,454 B1 8/2002 West
6,447,389 B1 * 9/2002 Kuo ..... F24F 13/06 454/248
6,520,247 B2 * 2/2003 Hultmark ..... F24F 1/0011 165/123
6,569,010 B1 * 5/2003 Miller ..... F24F 1/01 454/233
6,769,477 B2 * 8/2004 Hakkinen ..... F24F 1/0059 165/123
7,000,688 B2 * 2/2006 Horttanainen ..... F24F 11/027 165/123
7,384,168 B2 * 6/2008 Whitlow ..... F21V 33/0088 362/149
8,327,836 B2 12/2012 Brown et al.
8,469,783 B2 * 6/2013 Juslin ..... F24F 1/01 454/237
8,876,581 B2 * 11/2014 Ulmanen ..... F24F 1/0007 454/261
2002/0056545 A1 * 5/2002 Horttanainen ..... F24F 1/01 165/96
2002/0062948 A1 * 5/2002 Horttanainen ..... F24F 1/01 165/123
2002/0070010 A1 * 6/2002 Hakkinen ..... F24F 1/0059 165/123
2003/0042012 A1 3/2003 Pearson
2005/0056042 A1 3/2005 Bourne et al.
2005/0132677 A1 * 6/2005 Bauer ..... F24F 3/161 55/385.2
2005/0287944 A1 * 12/2005 Choi ..... F24F 12/006 454/234
2005/0287945 A1 * 12/2005 Choi ..... F24F 7/08 454/234
2005/0287946 A1 * 12/2005 Kim ..... F24F 12/006 454/234
2006/0199511 A1 * 9/2006 Chung ..... F24F 12/006 454/237
2006/0211365 A1 * 9/2006 Petrovic ..... F24F 1/01 454/261
2008/0112128 A1 * 5/2008 Holland ..... F24F 1/01 361/679.53
2008/0200112 A1 * 8/2008 Ulmanen ..... F24F 1/0007 454/261
2008/0236785 A1 * 10/2008 Nikula ..... F24F 1/01 165/48.1
2009/0264062 A1 * 10/2009 Miller ..... F24F 1/0059 454/237
2010/0140363 A1 * 6/2010 Hirsch ..... G05D 7/0635 236/12.1
2010/0242726 A1 * 9/2010 Enbom ..... F24F 1/01 95/58
2010/0263829 A1 * 10/2010 Kimura ..... F24F 1/01 165/59
2011/0124279 A1 * 5/2011 Paavilainen ..... F24F 1/0007 454/264
2011/0155354 A1 * 6/2011 Karamanos ..... F24F 3/052 165/121
2011/0189939 A1 * 8/2011 Fey ..... F24F 1/01 454/339
2012/0015600 A1 * 1/2012 Larsson ..... F24F 1/01 454/254
2012/0118535 A1 * 5/2012 Williams ..... F24F 1/01 165/104.14
2012/0216986 A1 * 8/2012 Kjellerstedt ..... F24F 1/0059 165/59
2012/0245739 A1 9/2012 Grabon et al.
2012/0291994 A1 * 11/2012 Ainley ..... F24F 1/0059 165/104.11
2012/0295532 A1 11/2012 Bagwell et al.
2014/0374063 A1 * 12/2014 Paavilainen ..... F24F 1/0007 165/96

FOREIGN PATENT DOCUMENTS

CN 1123568 A 5/1996
CN 101057205 A 10/2007
CN 101576299 A 11/2009
CN 101576304 A 11/2009
CN 202133068 U 2/2012
DE 3719134 12/1988
EP 0023757 A1 2/1981
EP 2244021 A2 10/2010
EP 2333436 6/2011
GB 2322934 9/1998
WO WO 2003/102484 A2 12/2003
WO WO 2007/063355 A1 6/2007
WO WO 2008/119893 A1 10/2008
WO WO 2010/061205 A1 6/2010
WO 2011091380 A1 7/2011

OTHER PUBLICATIONS

Office Action for Chinese Patent Application No. 201380025517.X dated Sep. 5, 2016.
Communication pursuant to Article 94(3), dated Jun. 11, 2014, in European Patent Application No. 11735324.3.
Specification, claims, and drawings, and accompanying preliminary amendment, of U.S. Appl. No. 14/266,806, filed Apr. 30, 2014.
Office Action, dated Jun. 25, 2014, in Australian Application No. 2011207455.
Office Action, dated Mar. 27, 2014, in Chinese Patent Application No. 201180007024.4.
Supplementary European Search Report and Search Opinion, dated Aug. 18, 2013, in European Patent Application No. 11735324.3.
European Patent Office action for patent application No. 13733034.6-1602 Communication pursuant to Rules 161(1) and 162 EPC dated Nov. 14, 2014.
European Patent Office action for patent application No. 13733034.6-1602/2825826 Communication of European publication number and information on the application of Article 67(3) EPC dated Jan. 5, 2015.
Examination Report for Australian Patent Application No. 2013234030 dated Jan. 13, 2017.
International Preliminary Report on Patentability for PCT/IB2013/00771 dated Sep. 16, 2014.
Office Action for Mexican Patent Application No. MX/a/2014/010922 dated Oct. 6, 2017 (includes English language translation).

* cited by examiner

CHILLED BEAM WITH MULTIPLE MODES

BACKGROUND

The invention relates to a terminal device, through which ventilation air and recirculating air flows and more particularly to such terminal devices in which supply air is sometimes used to induce at least a part of the recirculating air flow across a heat exchange for heating and/or cooling.

For the cooling of rooms, commonly known systems employ terminal devices in each conditioned space that supply primary air from a central ventilation system. A high velocity may be used to ensure mixing of the air in the conditioned space. The high velocity air may be generated from a mixture of primary and secondary air from the terminal device. If the secondary air also enters the terminal air device via a heat exchanger, or the terminal device includes one, at least part of the heating or cooling load can be satisfied by the heat exchanger load in addition to that provided by the primary ventilation air. A common example of such a system is an active chilled beam.

In active chilled beams, a cooling capacity can be partly satisfied by cold water piped to the chilled beam heat exchanger rather than requiring all of the cooling load to be satisfied by air handlers sized to carry sufficient volumes of cooled air via primary ventilation ductwork. As such, only the ventilation load need be handled by the air handling system. Also, chilled beams are suitable for mounting in ceilings or mounted flush with a suspended ceiling, but since they are standalone components, they can be mounted in many different ways. Latent load must be handled by distributed air, which is fresh, because chilled beams cannot satisfy the latent load of the terminal units themselves because they are not adapted for handling condensate.

Active chilled beams contain a coil in a plenum box hung or suspended from a ceiling. They use ventilation air introduced into the beam plenum through small air jets to magnify the natural induction of air. Active chilled beams have evolved. The term "active chilled beam" became an oxymoron, with active beams being used for cooling and heating. Beams are gaining popularity and are being designed for significantly higher space loads. To match increasing space loads, active beams are specified with higher airflows resulting in systems operating outside of their optimum performance resulting in active beams operating as expensive diffusers.

SUMMARY

The Summary describes and identifies features of some embodiments. It is presented as a convenient summary of some embodiments, but not all. Further the Summary does not identify critical or essential features of the embodiments, inventions, or claims.

A chilled beam provides separate primary and secondary plenums each of which generates respective flow induction jets. The primary air, categorically the air that provides fresh ventilation air and satisfies a predefined design ventilation load, can generate and induced recirculating flow through the chilled beam heat exchanger. At times of low ventilation requirements and substantial thermal load, a secondary flow of air can be provided by a terminal unit to satisfy a load while the primary air flow is lowered to meet a low ventilation requirement, for example at night.

Objects and advantages of embodiments of the disclosed subject matter will become apparent from the following description when considered in conjunction with the accompanying drawings.

BRIEF DESCRIPTION OF THE DRAWINGS

Embodiments will hereinafter be described in detail below with reference to the accompanying drawings, wherein like reference numerals represent like elements. The accompanying drawings have not necessarily been drawn to scale. Where applicable, some features may not be illustrated to assist in the description of underlying features.

DESCRIPTION OF EMBODIMENTS

Figure 1:
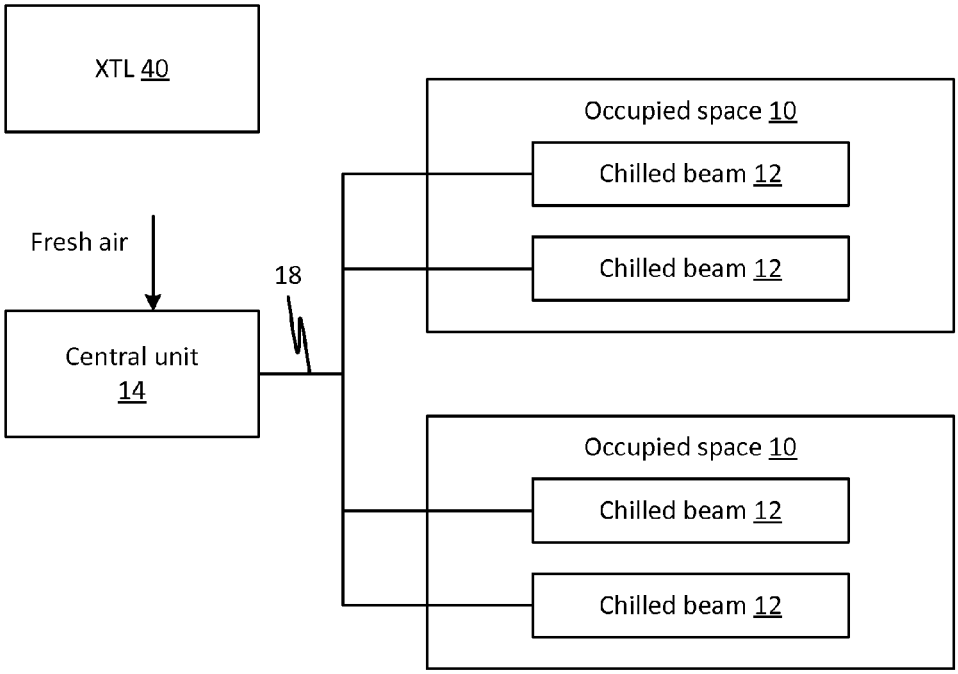
FIG. 1 shows a chilled beam system in which fresh air is supplied, with or without conditioning such as heating or cooling, to chilled beam units according to embodiments of the disclosed subject matter. The chilled beams may be of the form of any of the chilled beam embodiments described herein.

Referring to FIG. 1, a chilled beam air system supplies conditioned and/or unconditioned ventilation air from a central unit 14 to one or more conditioned spaces 10 or zones. The conditioned spaces may be rooms of any type or sets of rooms, or any type occupied spaced. Occupied spaces generally require a certain amount of ventilation for health and comfort of occupants. The central unit 14 draws in fresh air from outside the occupied spaces (e.g., 10) and distributes fresh primary air through a duct network 18 to multiple chilled beams 12. Each occupied space may have one or more chilled beams 12.

Chilled beams 14 may be of the type known as active chilled beam 12, which combine a discharge register for the primary air supplied to them and also provide additional sensible cooling using a heat exchanger. The chilled beams 12 are generally installed within or near a ceiling. The discharge register portion receives primary air that is conditioned to satisfy the latent load of the conditioned space 10, the ventilation requirements of the conditioned space 10, and some of the sensible load of the conditioned space. The sensible load is further satisfied in an active chilled beam 12 by cooling primary and some secondary conditioned space air using the heat exchanger portion. The rate of flow of heat transfer fluid to heat exchanger built into the chilled beam 14 regulates the cooling capacity. In embodiments of chilled beams 10, the primary air is ejected through nozzles to create a secondary flow by induction of air through the heat exchanger. Heat transfer fluid is pumped through the heat exchanger at a temperature that is above the dew point to prevent the heat exchanger portion causing condensation.

Active chilled beams provide benefits in areas with substantial sensible cooling and heating requirements and relatively mild ventilation requirements. This is because they can save on the primary air requirements associated with traditional VAV systems. Active chilled beams tend to operate at low noise levels.

In addition, due to the very low noise levels of active chilled beams buildings that have special noise levels requirements are good candidates. Finally zones where there is high concern about indoor environment quality are ideal candidates as the conditioned spaces are provided with proper ventilation air and humidity control at all times and under all load conditions.

Figure 2:
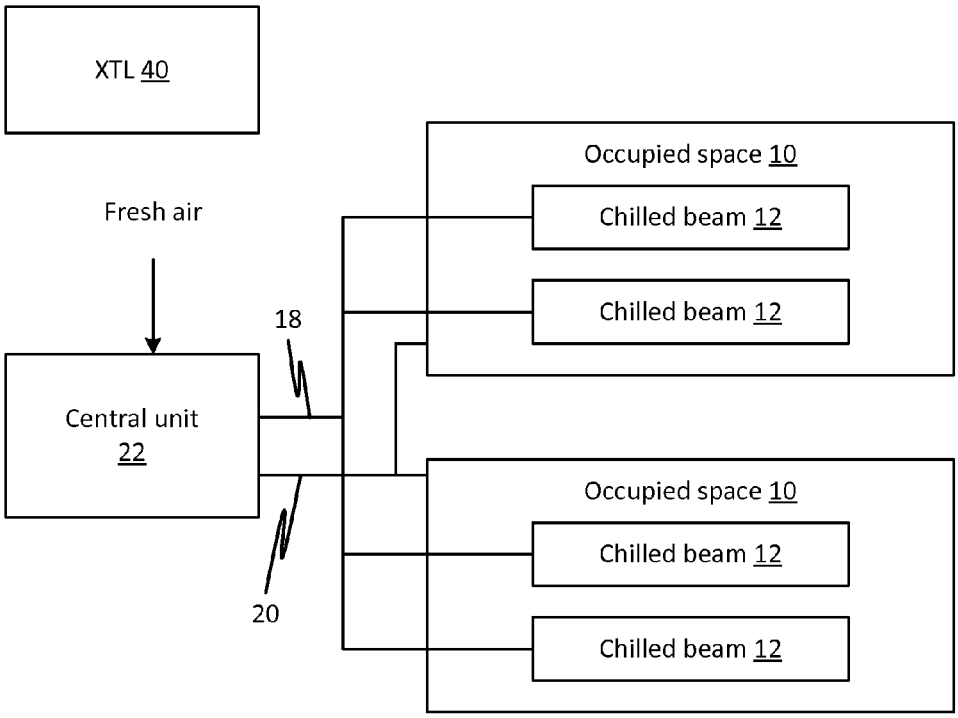
FIG. 2 shows a chilled beam system in which conditioned air is returned to a central air handler which mixes the returned air with ventilation air and supplies the resulting mix to chilled beam units, according to embodiments of the disclosed subject matter. The chilled beams may be of the form of any of the chilled beam embodiments described herein.

Generally, active chilled beams in a zone are supplied by a respective central unit 14 such as an air handling unit, rooftop unit or any other suitable ventilation device which has, at least, a fan, and may also provide a supply of air from a fresh air source. The central unit may provide conditioning to recirculating as shown in FIG. 2 where central unit 22 draws return air from the occupied spaces through a return air duct network 20.

The air handling units 14, 22 can provide temperature-neutral latent load reduction by, for example, a desiccant wheel. The water temperature can be controlled by a control valve regulating flow through the heat exchanger portion from a water supply to a return. Water temperature can also be controlled by varying the rate of flow on either side of a heat exchanger in the chilled beam that removes heat from the water.

In all of the embodiments, chilled beams 12 and as described elsewhere herein, may include directional louvers, lighting, loudspeakers, and aesthetic panel or other elements. In all of the embodiments, central unit 14, 22 may be a single unit or multiple units with respective functions, for example, a separate fan unit, air conditioning unit, which may include a vapor compression machine, a desiccant dehydration device or a heater, filter unit, and mixing unit that combines fresh and return air may be interconnected to form a central unit 14, 22.

As known in the art for chilled beams, and although not shown, each chilled beam receives a heat transfer fluid, such as water, which flows through a heat exchanger in the chilled beam. The flow of heat transfer fluid is regulated by demand for each chilled beam or for each occupied space or for each zone. The flow of heat transfer fluid may be increased, during cooling season, when the load indicated by a sensor such as a thermostat, indicates higher temperatures and the reverse when the sensor indicates comfortable temperatures or low temperatures.

Figure 3A:
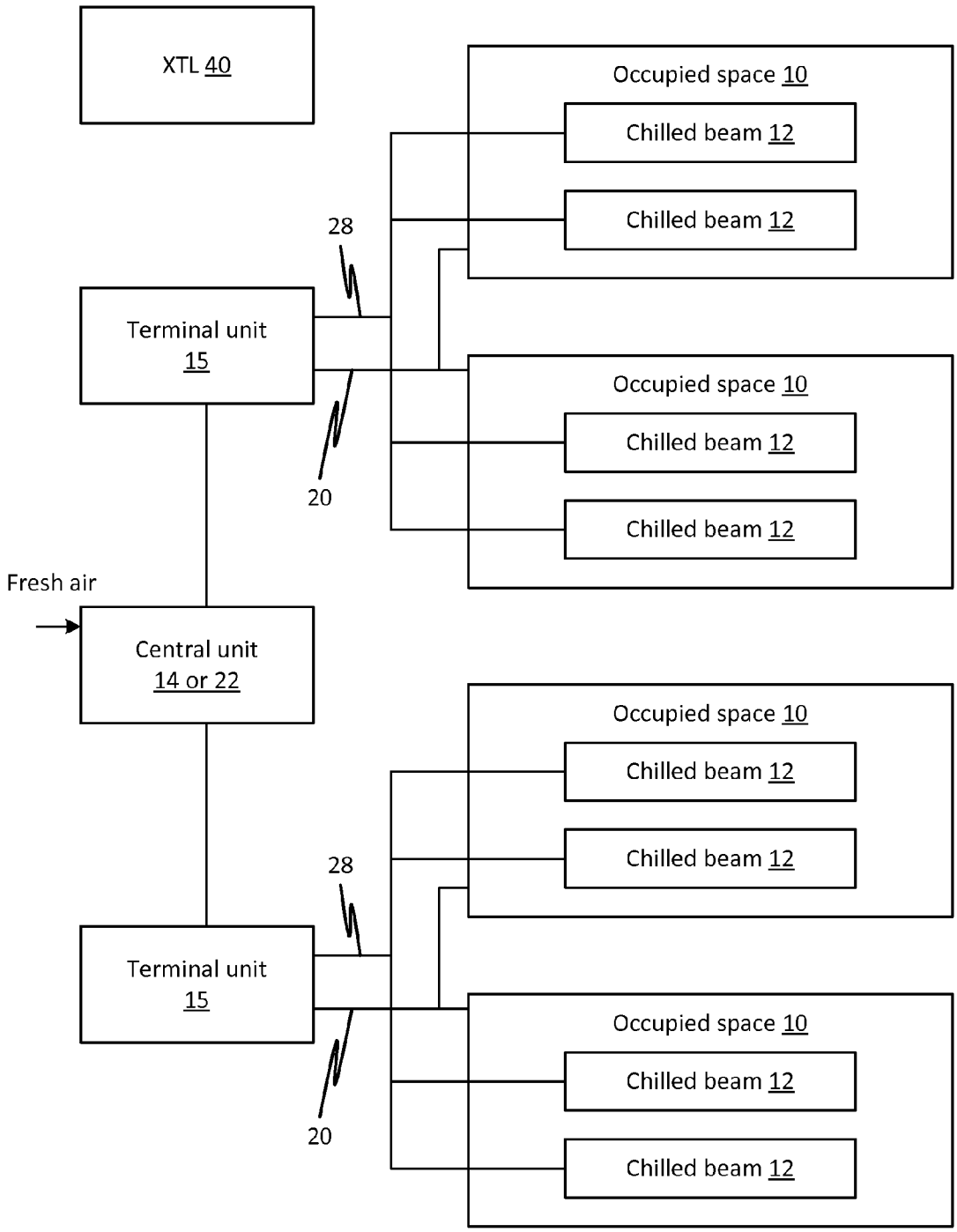
FIG. 3A shows a chilled beam system in which ventilation air is supplied by a central air handler to multiple terminal units each of which supplies to the chilled beams in a respective conditioned space or zone, according to embodiments of the disclosed subject matter. The terminal units may provide cooling and/or heating. The chilled beams may be of the form of any of the chilled beam embodiments described herein.

Referring now to FIG. 3A, a conditioned space load is satisfied in the present embodiment by conveying primary air from a central unit 14 or 22 (the central unit in FIGS. 3A-3D may be of either type, providing only ventilation air or providing a mixture of conditioned ventilation air and recirculate air from the occupied spaces 10). The air is supplied from the central unit 14 or 22 to the primary air inlet of chilled beam 12 through terminal units 15. Alternatively, the terminal units 15 may supplement the central unit 14, 22 by providing additional supply to the chilled beams 12. In either case, air is supplied by the terminal units through a respective duct network 28.

The terminal units supply air and, optionally, supplemental air conditioning to air returned from the covered occupied space 10 or spaces. The terminal units may be configured to mix return air from the covered occupied space or spaces with air from the central unit. Air from the central unit may be supplied to the duct network 28 directly to add conditioned fresh air to the return air supplied through the terminal unit 15.

There may be one terminal unit 15 for each room, for each zone (with multiple rooms) or according to any scheme. In the embodiments, the terminal units 15 are provided in a hierarchical scheme in which each terminal unit is connected to a subset of all the occupied spaces 10 served by the central unit 14 or 22. The terminal units 15 may be of various configurations. In first configurations, they are mixing devices that mix selected ratios of return and fresh air and so provide capacity to supplement the central unit 14 or 22. The terminal units may alternatively, or in addition, have fans that provide draw air from the occupied spaces 10 and, optionally treat it some way (filtering, air conditioning, etc.) and supply the resulting treated air to the chilled beams 12.

Terminal units 15 may be as described in International Publication No. WO-2011/091380, for example. Thus, they may supply heating, filtration, air conditioning, desiccant enthalpy reduction, fresh air, or any other form of air treatment. The control of the central unit 14, 22 and the terminal units may be such that the central unit 14, 22 provides a base load based on first criteria whilst the terminal units 15 are controlled based on signals from the respective zone covered by the terminal unit. For example, one or more controllers (represented figuratively as a controller facility 40) may be programmed or otherwise configured to control the terminal units 15 based on thermostats in the occupied space 10. If a terminal unit supports multiple separated spaces, the terminal units 15 may be controlled respectively according to a local baseline load and rely on local control of the chilled beam to provide the supplemental capacity required. For example, suppose two hotel rooms each have a thermostat and temperature sensor and the two rooms have one or more chilled beams 12 each connected to a single shared terminal unit 15. The terminal unit may be controlled based on the signal from the lowest difference between the thermostat setting and the room temperature. Alternatively, an algorithm may be used by a programmable controller to predict the combined loads of both occupied spaces 10 and the terminal unit controlled to deliver the required capacity to both spaces. The terminal units may be further provided with dampers to transfer more air to the higher load occupied space 10, as in a VAC system.

Figure 3B:
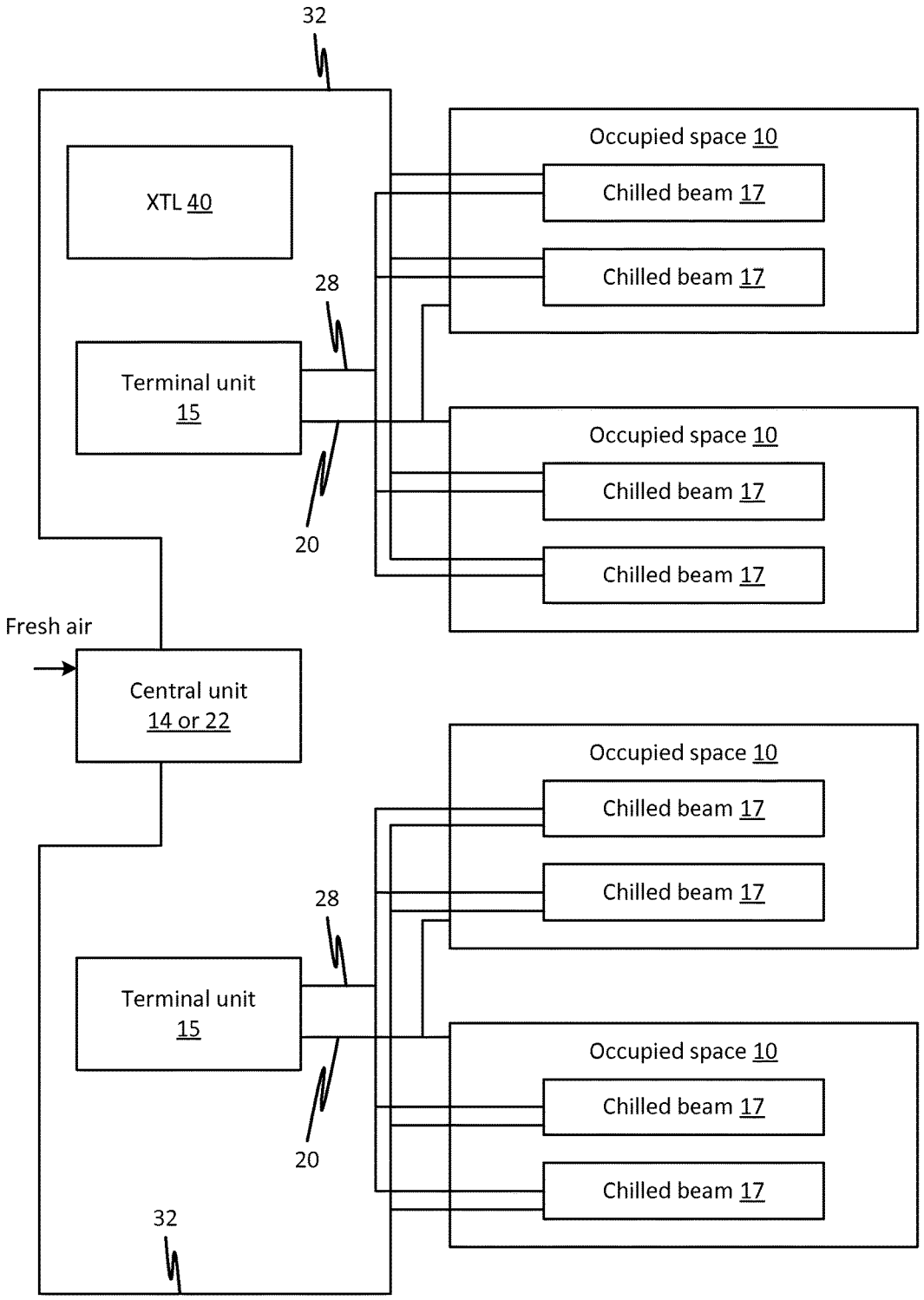
FIG. 3B shows a chilled beam system in which ventilation air is supplied by a central air handler to multiple terminal units each of which supplies to the chilled beams in a respective conditioned space or zone, according to embodiments of the disclosed subject matter. The terminal units may provide cooling and/or heating or other conditioning. The chilled beams may be of the form of any of the chilled beam embodiments described herein. In the present embodiment, separate duct networks are provided for primary and secondary air with respective primary and secondary air inlets on each chilled beam.

The embodiments described with regard to FIG. 3A may be modified such that fresh air from the central unit 14, 22 is supplied to the chilled beams 12 through a different connection of the chilled beams 12 than recirculated air from terminal units 15. Embodiments of such chilled beams are disclosed in the present application. The system of FIG. 3B is similar to that of FIG. 3A except that separate primary and secondary supplies to the chilled beams 17 are provided. The primary supply may be as described in the foregoing embodiments. In an embodiment, the secondary supply is provided through a duct network 28 which supplies conditioned return (generically referred to as secondary because in embodiments it is not conditioned or comes from a source other than fresh ventilation air, which may include mixed fresh ventilation air and return air, conditioned or not).

The provision of separate primary and secondary air inlets of the respective chilled beams 17, may provide additional functions to the chilled beams 17 and systems. For example, in embodiments, the secondary supply flow volume can be varied depending on the load by the terminal unit 15. This may be used, for example, to change the ratio of recirculated room air and fresh ventilation air and also can be used to vary the velocity of air through the chilled beam 17 heat exchangers by adding a stronger jet flow thereby increasing the induction effect via high velocity jets. For example, the terminal unit 15 control could receive sensor signals indicating the load in the occupied space and the chilled water temperature flowing to the chilled beam heat exchangers and raise the flow rate of recirculated air to increase the induced flow to compensate.

Figure 3C:
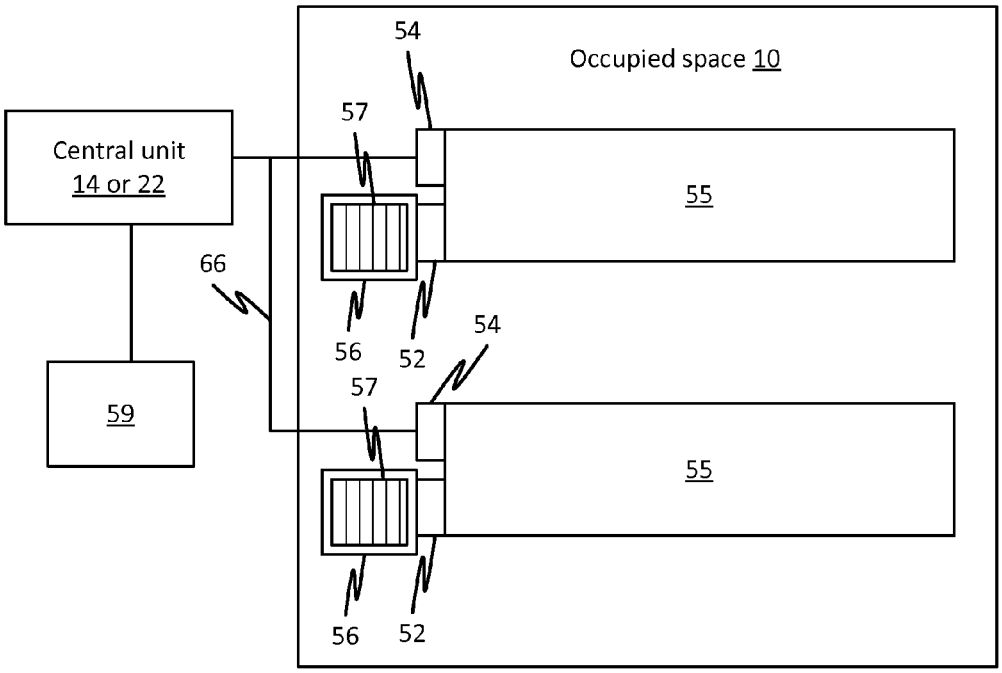
FIGS. 3C and 3D show embodiments of chilled beam systems in which local terminal unit functionality or a powered supply of locally recirculating air is provided to each chilled beam. To accomplish this, in embodiments, each chilled beam may have a fan unit with an intake register. In embodiments of chilled beams with multiple inlets, each respective to primary and secondary air supply, the fan unit is attached to the secondary air supply and the central unit or the terminal unit (or both) is connected to the primary air supply.
Figure 3D:
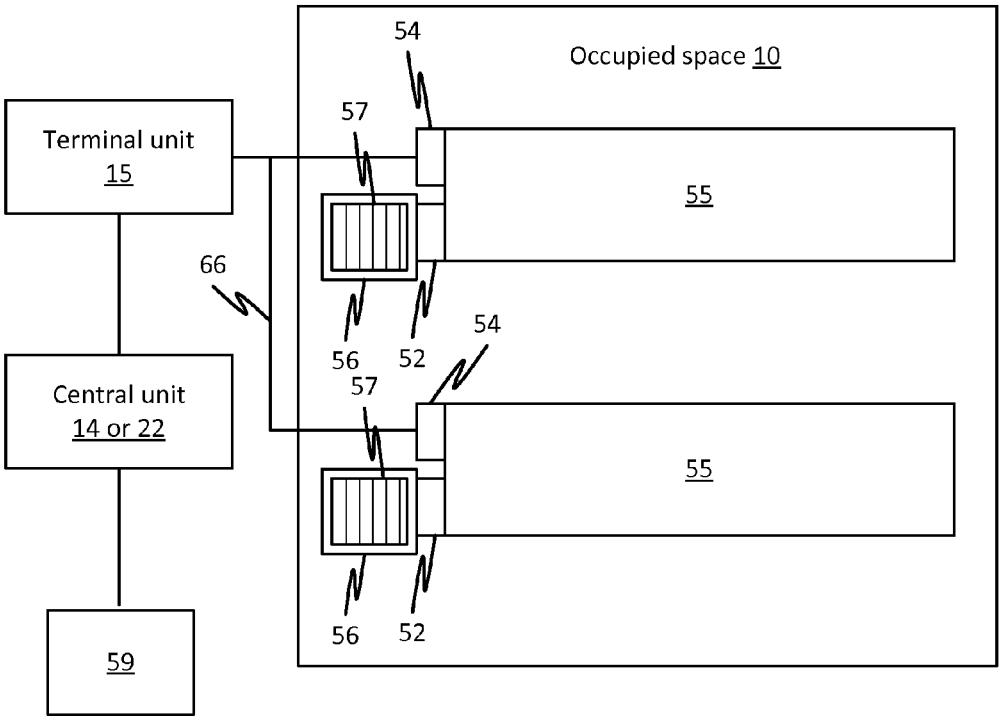

Referring now to FIGS. 3C and 3D, chilled beams 55 have primary 54 and secondary 52 inlets. The primary inlets 54 receive air directly from a central unit 15 which also supplies primary air to chilled beams in other occupied spaces 59. The secondary air inlets 52 each receive air from a dedicated fan unit 56 which draws air from the occupied space 10 through an intake register 57 and supplies it at pressure to the secondary air inlet 52. In the embodiment of FIG. 3D, the primary air inlet 54 of each chilled beam 55 is supplied with air at pressure from a terminal unit 15 as described according to any of the embodiments disclosed herein. The system layout may be as described in the foregoing embodiments as well. In any given occupied space, any number of chilled beams may have a dedicated fan unit including all or a subset of the chilled beams.

Figure 4:
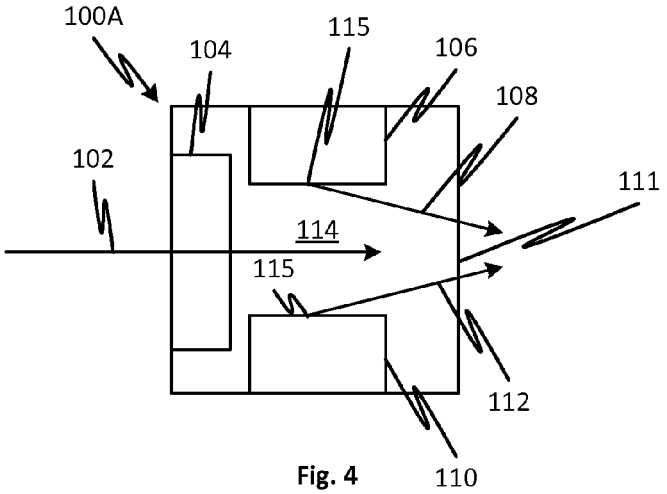
FIG. 4 shows a chilled beam with separate primary and return air plenums, each of which generates a respective induction jet which is conveyed into a common mixing chamber to induce flow through a heat exchanger.

FIG. 4 shows a schematic of a chilled beam 100A in a cross-section with separate primary 106 and secondary 110 plenums. The primary plenum 106 is configured to receive air through a primary air inlet and the secondary air plenum 110 is configured to receive from a secondary air inlet. The primary and secondary air inlets (not shown) may be connected to systems according to any of the embodiments described. Each plenum 106,110 has orifices or slots 115 to generate respective jets 108, 112 along a length of the chilled beam 100A (which goes into the drawing page). Note that the angular projection of the jets 108 and 112 may be achieved by providing a small angled portion or a flow deflector. The orifices and shapes of the plenums may be altered to provide a desired jet direction. The flow of the jets 108, 112 through and out of mixing chamber 114 induces air into the mixing chamber 114 drawing it through a heat exchanger 104 as indicated at 102. The induced air and jets mix and flow out of a discharge opening 111. The chilled beam 100A may be used in any of the embodiments disclosed which have primary and secondary air inlets. The specific configuration is figurative. The directions of the flow of air, proportions, and arrangements of components can be varied to suit different technical and aesthetic requirements or preferences. Details such as suitable connection collars for connection to ductwork may be provided, but are not shown.

Figure 5:
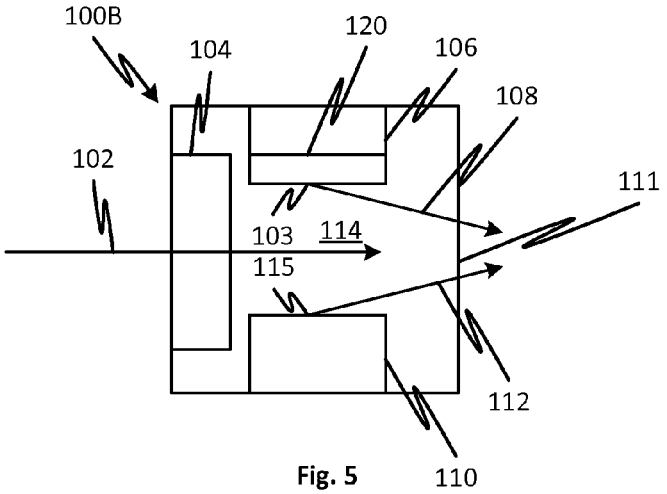
FIG. 5 shows a chilled beam with separate primary and return air plenums, each of which generates a respective induction jet which is conveyed into a common mixing chamber to induce flow through a heat exchanger. The present embodiment illustrates a feature of a flow control arrangement that can be used in combination with others on any of the chilled beam embodiments disclosed herein.

FIG. 5 shows a schematic of a chilled beam 100B in a cross-section with separate primary 106 and secondary 110 plenums. The primary plenum 106 is configured to receive air through a primary air inlet and the secondary air plenum is configured to receive from a secondary air inlet. The primary and secondary air inlets (not shown) may be connected to systems according to any of the embodiments described. Each plenum 106, 110 has orifices or slots 103, 115 to generate respective jets 108, 112 along a length of the chilled beam 100B (which goes into the drawing page). The flow of the jets 108, 112 through and out of mixing chamber 114 induces air into the mixing chamber 114 drawing it through a heat exchanger 104 as indicated at 102. The induced air and jets mix and flow out of a discharge opening 111. The chilled beam 100B may be used in any of the embodiments disclosed which have primary and secondary air inlets. In the present embodiment, the primary air plenum 106 has a flow control device 120 such as a damper, variable sized orifices or slots, or orifices whose number and spacing may be varied. The flow control device 120, embodiments of which are described below, may be used to vary the flow rate for the entire chilled beam 100B or may control the proportion of the flow distributed to different parts of the beam 100B. The flow control device may be manually adjusted or motorized and controlled by a controller (e.g., controller 40 or one integrated in the chilled beam). The flow control device 120 is shown on the primary plenum but may be used on the secondary air plenum as well or on both, as shown in the embodiment 100C of FIG. 6, which is in other respects the same as the present embodiment 100B. In addition, the flow control device may be positioned on the inlet side of the primary or secondary inlet plenum (see, for example, the embodiments of FIGS. 7A and 7B) or on the outlet side where the jets are formed (See for example, the embodiments of FIGS. 8A and 9A). By allowing the selection of different flow rates of the primary air at different parts of the beam, the capacity of the beam can be varied to suit the loads immediately beneath the different parts. For example, a beam placed over work cubicles in an office may configured to concentrate the capacity at occupant workstations or temperature sensors along the beam may be used to regulate the local flow rate. The present configuration is figurative. The directions of the flow of air, proportions, and arrangements of components can be varied to suit different technical and aesthetic requirements or preferences. Connection collars for connection to ductwork may be provided, but are not shown.

Figure 6:
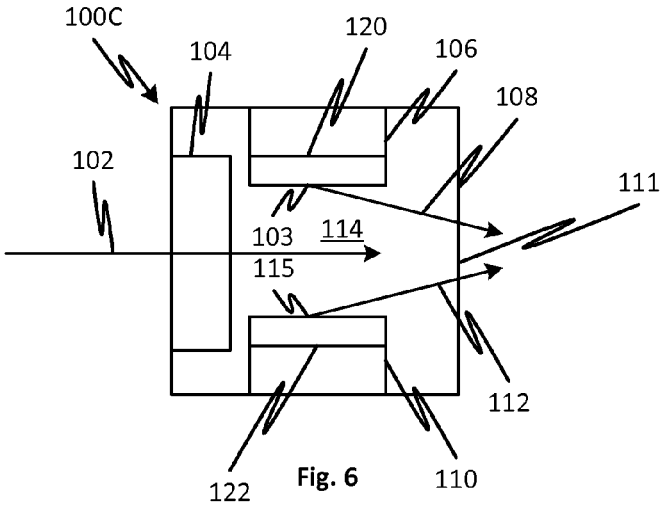
FIG. 6 shows a chilled beam with separate primary and return air plenums, each of which generates a respective induction jet which is conveyed into a common mixing chamber to induce flow through a heat exchanger. The present embodiment illustrates a feature of a flow control arrangement that can be used in combination with others on any of the chilled beam embodiments disclosed herein.

FIG. 6 shows a chilled beam with separate primary and return air plenums, each of which generates a respective induction jet which is conveyed into a common mixing chamber to induce flow through a heat exchanger. The present embodiment illustrates a feature of a flow control arrangement that can be used in combination with others on any of the chilled beam embodiments disclosed herein.

Figure 7A:
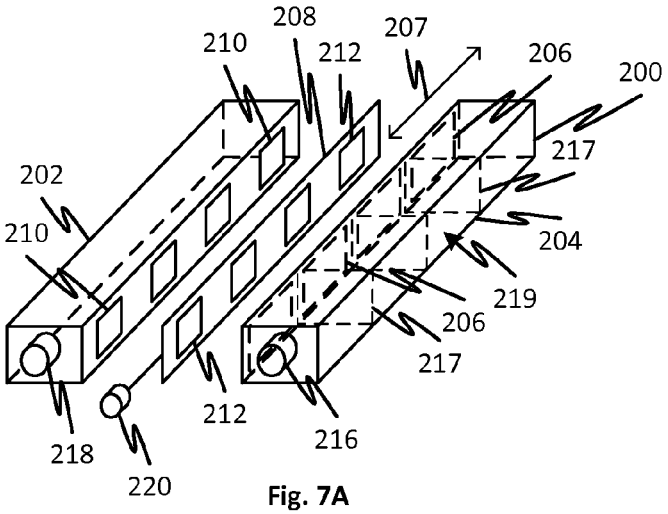
FIG. 7A shows an exploded view of a chilled beam with a manifold plenum that distributes air to plenum segments distributed along a longitudinal dimension of the beam and an optional feature, namely a controllable damper that allows the flow from the manifold to be varied, for example, automatically by a control system or manually.

FIG. 7A shows an exploded view of a chilled beam 200 with a manifold plenum 202 that distributes air to plenum segments, one of which is indicated at 219. The plenum segments 219 are separated by partitions 217. They are distributed along a longitudinal dimension of the beam 200 and receive air through openings 206. The illustrated plenum segments 219 open to orifices for secondary air jet (not shown) and are fed from the manifold plenum 202 through a secondary air inlet 218. The manifold plenum 202 is pressurized by a flow of air into the inlet 218 such that air flows out openings 210 through openings 212 in a damper blade 208, then finally through the respective openings 206 into the plenum segments 219 of the chilled beam 200. By moving the damper blade 208 longitudinally (as indicated by arrows 207) the effective open area through openings 210 and 212 can be varied. The damper blade 208 may be driven manually or by motors 220, under control by a controller. Primary air may be supplied through the primary air inlet 216 which is distributed along a length of a beam through duct which is not shown but which may be of any suitable description and various examples are shown in the present disclosure.

In embodiments, the damper blade 208 is not present. In such embodiments, the openings 210 serve as flow restrictions alone and help to balance the flow into the respective plenum segments 219. In alternative embodiments, the manifold plenum 202 is used to distribute primary air instead of secondary air. Also, other types of flow regulation devices may be substituted for the damper blade 208 including louver type devices, iris mechanisms, and other known flow regulation devices. In addition, a single flow regulator may be used at the inlet.

Figure 7B:
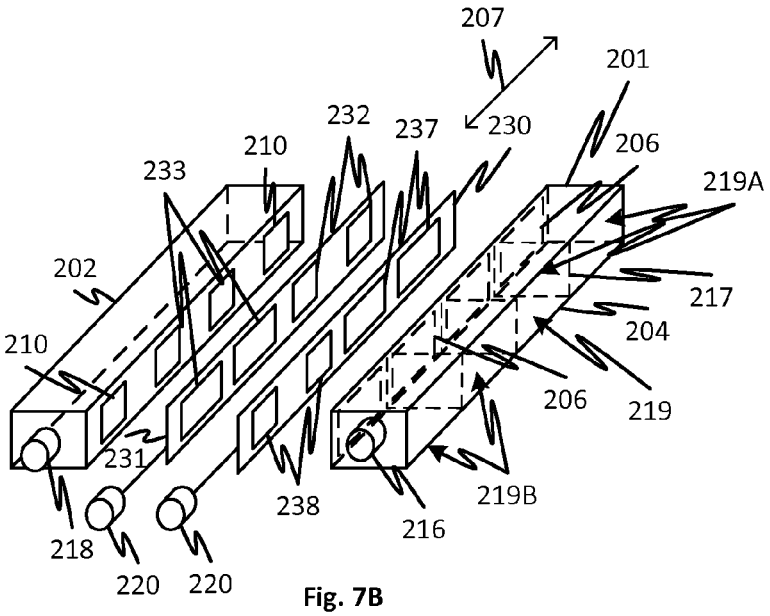
FIG. 7B shows an exploded view of a chilled beam with a manifold plenum that distributes air to plenum segments distributed along a longitudinal dimension of the beam and an optional feature, namely a controllable damper that allows the flow from the manifold to be varied, for example, automatically by a control system or manually to vary the flow in certain segments independently of the flow other segments to allow the flow along the length of the beam to be varied.

FIG. 7B shows an exploded view of a chilled beam 201 with elements similar to those shown in FIG. 7A. The manifold plenum 202 distributes air to plenum segments 219. The plenum segments 219 are separated by partitions 217 and are distributed along a longitudinal dimension of the beam 200. The plenum segments 219 receive air through openings 206. The plenum segments 219 open to orifices for secondary air jets (not shown) and are fed from the manifold plenum 202 through a secondary air inlet 218. The manifold plenum 202 is pressurized by a flow of air into the inlet 218 such that air flows out openings 210 through small openings 232 and then large openings 237 (or through large openings 233 then through small openings 238) in damper blades 231 and 230, and finally through the respective openings 206 into the plenum segments 219 of the chilled beam 200. By moving the damper blades 231 longitudinally (as indicated by arrows 207) the effective open area through openings 210 and small openings 232 can be varied with large openings 237 not restricting irrespective of the position of damper blade 230, within the range of the latter. By moving the damper blades 230 longitudinally (as indicated by arrows 207) the effective open area through openings 210 and small openings 238 can be varied with large openings 233 not restricting irrespective of the position of damper blade 231, within the range of the latter. Thus, it will be observed that the flow to a first subset of the plenum segments 219, namely 219A can be controlled independently of the flow to a second subset of the plenum segments 219, namely 219B. The damper blades 230 and 231 may be driven manually or by motors 220, under control by a controller. As in the embodiment of FIG. 7A, primary air may be supplied through the primary air inlet 216 which is distributed along a length of a beam through duct which is not shown but which may be of any suitable description and various examples are shown in the present disclosure.

In embodiments, only one damper blade is present so that flow in only a subset of the plenum segments 219 is regulated. In alternative embodiments, the manifold plenum 202 is used to distribute primary air instead of secondary air.

Figure 7C:
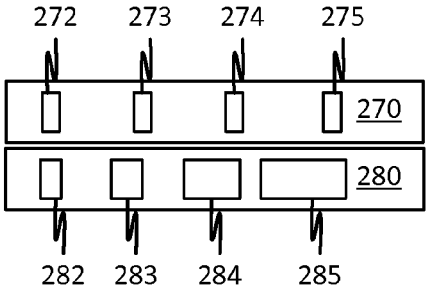
FIG. 7C shows a damper blade, plenum arrangement that progressively opens plenum chambers one after another as one of the dampers is displaced.

FIG. 7C shows damper configuration in which the manifold plenum 202 has the form indicated at 270 with openings 210 replaced by the openings 272 through 275. A single damper blade 280 is used with the revised plenum box. That is, replace the damper blade 208 of the embodiment of FIG.

7A with the damper blade 280 and openings 201 replaced with openings 272 through 275 on the manifold plenum 202. It can be confirmed by inspection that progressively displacing the damper blade 280 and openings 282 to 285, relative to the openings 272 through 275 causes an effective opening to arise first with openings 275 and 285, then an effective opening arises between 274 and 284, then an effective opening arises between 283 and 273, and finally a last effective opening between openings 272 and 282 arises. As each effective opening arises, the previous one remains. Thus, a greater and greater fraction of the chilled beam 200 capacity can be provided. The feature may be applied to single plenum active beams as well. In an application to a system, as the load increases, more and more recirculation air may be added to the chilled beam flow to drive air through the heat exchanger in response to a load signal. This may be done without the need to demand more air from the central air unit.

Figure 8A:
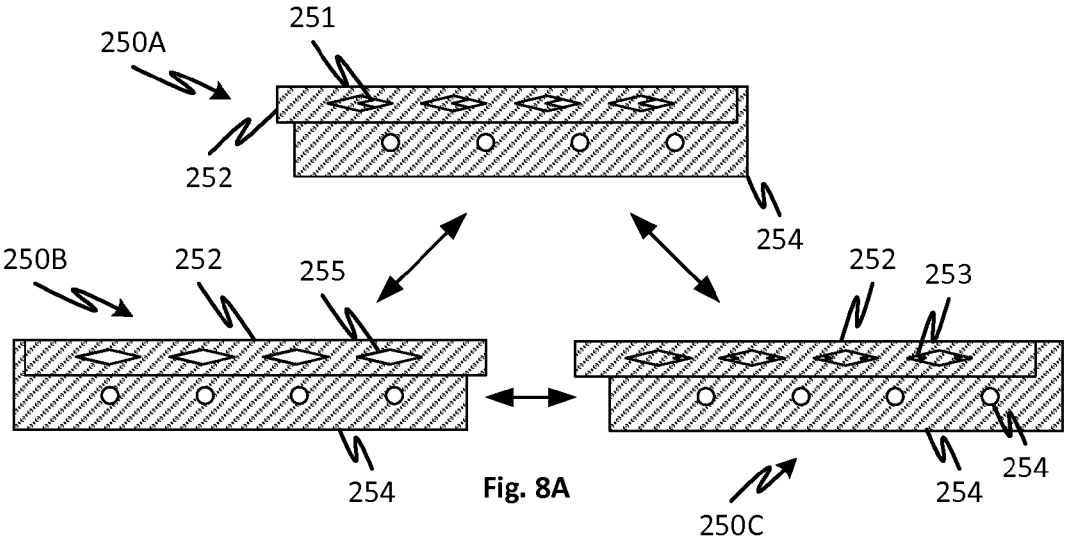
FIGS. 8A and 8B show a controllable damper device that forms jets which may be used with any of the chilled beam embodiments. Three modes are obtainable, one with jet nozzles of a first size, a range with jet nozzles of selected variable size, and where the jets are smaller and more numerous than the first, the latter for increasing the jet induction ratio.
Figure 8B:
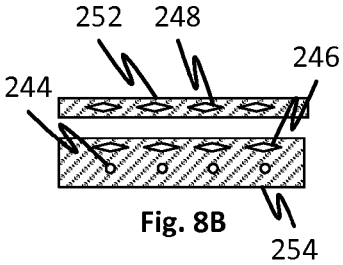

FIGS. 8A and 8B show a controllable damper device that forms jets which may be used with any of the chilled beam embodiments. Two overlapping blades 252 and 254 in a first position shown at 250A provide a first set of orifices 251 of a first size. The size of the orifices 251 can be increased progressively up to a second size indicated at 255 in the configuration indicated at 250B by moving the blades 252 and 254 relative to each other in the longitudinal direction. The size of the orifices 251 can be effectively doubled in number and reduced in size as indicated at 253 in the configuration indicated at 250C by moving the blades 252 and 254 relative to each other in the longitudinal direction in the opposite direction or further. In all configurations, and ones in between, orifices 254 remain constant. The orifices 251, 255, and 253 may be used to form jets from the primary or secondary air of the chilled beam embodiments described herein. For example, they may be provided to form the flow control device of the embodiments 100B and 100C of FIGS. 5 and 6 and similar. By changing the spacing of the orifices, the entrainment ratio of the jets may be altered. That is, a smaller number of large orifices entrain less surrounding air along their initial projection distance than a larger number of smaller orifices, even though the flow volume for the two may the same. Of course in most geometries the difference in entrainment ratio is nullified a certain distance away. FIG. 8B shows the blades 252 and 254 separately so that the respective openings 248 and 246 can be seen. As used in this context, the entrainment ratio refers to the ratio of the air around the jet or jets to the flow emanating from the jet generators (e.g., orifices in this case). The selectable entrainment ratio may be used to select the amount of entrained flow induced through the chilled beam heat exchangers. The feature may be used in any of the embodiments and may be applied to jets of primary flow or secondary flow or both in the chilled beams with separate primary and secondary air plenums. The feature of variable flow jets and variable entrainment ratio jets may be applied to traditional active chilled beams and to the latter as applied to applicable system embodiments disclosed herein.

Although the embodiment above shows a way to achieve variable spacing and variable orifice sizes, it will be clear to those skilled in the arts that there are other ways to accomplish these functions. For example, any type of jet generator, such as nozzles may be used. Also the jet generators may be carried on parallel tracks bring pairs close to each other or space them equally apart. When two jet generators are close to each other, they have the effect, of forming a single jet thus the entrainment ratio can be altered in this way as well.

Figure 9B:
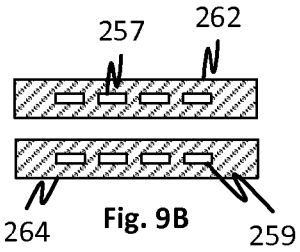
FIGS. 9A and 9B show a controllable damper device that forms jets which may be used with any of the chilled beam embodiments. Two modes are shown, one with jet nozzles of a first size and one where the jets are smaller and more numerous than the first, the latter for increasing the jet induction ratio.
Figure 9A:
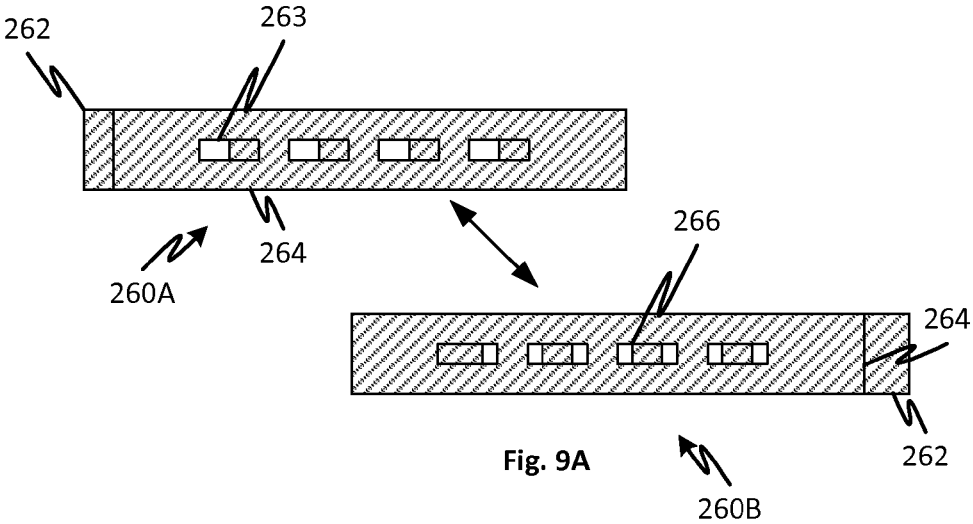

FIGS. 9A and 9B show a controllable damper device that forms jets which may be used with any of the chilled beam embodiments. Two modes are shown. A first mode 260A has orifices 263 of a first size and a second mode 260B has orifices 266 of a second size and increase number. It will be observed that with holes 257 and 259 in respective blades 262 and 264 in an overlapping arrangement, these modes may be obtained by sliding one blade relative to the other. The change in orifice spacing and size may be used to alter the entrainment ratio as in the embodiment of FIGS. 8A and 8B.

Figure 10:
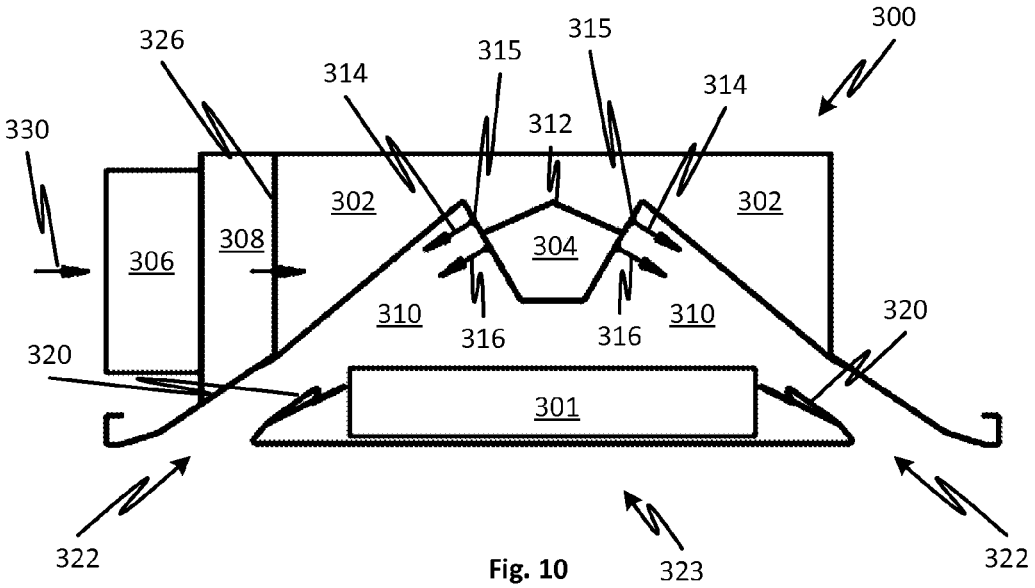
FIG. 10 shows a cross-section view of a chilled beam according to embodiments of the disclosed subject matter. The embodiment illustrates features and implementation aspects that provide manufacturability and performance benefits.
Figure 11:
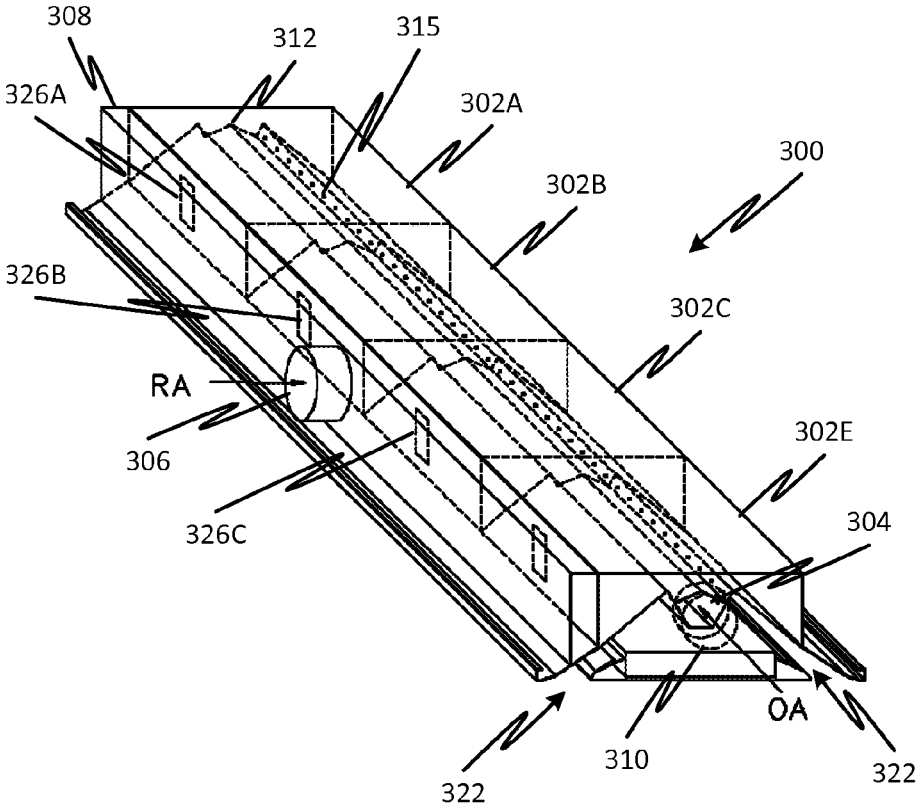
FIG. 11 shows an oblique view of the chilled beam embodiment of FIG. 10.

FIGS. 10 and 11 show a cross-section view of a chilled beam 300 according to embodiments of the disclosed subject matter. The embodiment illustrates features and implementation aspects that provide manufacturability and performance benefits. The chilled beam 300 receives secondary air through a return air collar 306 connected to convey the return air to a manifold plenum 308. Air in the manifold plenum 308 flows through openings 326 (326A, 326B, 326C, and 326D in FIG. 11) into secondary air plenums 302 which may be segmented as described with reference to FIGS. 7A and 7B (embodiment without the damper blades). The return air pressurizes the return air plenum 302 and flows through openings 315 to create jets of return air 314 that run along the length of the return air plenum 302 and are injected into a mixing chamber 310. This induces flow in the mixing chamber to induce room air through a heat exchanger 301 via an inlet 323 for induced return air. Supply air pressurizes the supply air plenum 304 to create jets of supply air 316 that run along the length of the supply air plenum 304 and are injected into the mixing chamber 310, also to induce room air through the heat exchanger 301. The induction process in other respects is essentially the same as for active chilled beams with the heat exchange performing cooling and also, in some systems and at certain times, in variations, heating. The heat exchanger may be supplied with hot or cold heat transfer fluid. Adjustable flow restrictors 320 may be provided to modify the velocity a mixed jets emitted from vents 322 into the occupied space.

It will be observed that the jets of primary and secondary air 314 and 316 form parallel sets that provide the same induction function. The flow control device 120 discussed above may be adapted for use in the present embodiment including the embodiments of FIGS. 8A and 9A. Although the manifold plenum 308 is positioned to the side of the secondary air plenum 302, in a variation, the manifold plenum 308 may be positioned on top of the secondary air plenum 302. Although the inlet collar 306 is attached to the side, it is possible for the inlet collar 306 to be attached to the manifold plenum at an end thereof. The secondary air plenum may be divided into any number of segments as illustrated by the four segments 302A, 302B, 302C, and 302D with each being fed by a respective one of the openings 326A, 326B, 326C, and 326D.

Figure 12:
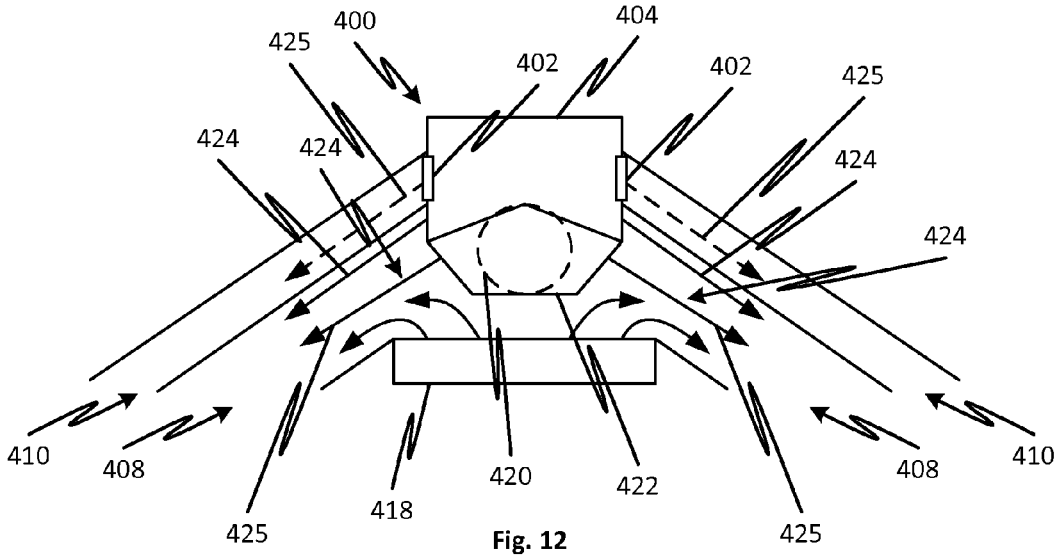
FIG. 12 shows a chilled beam embodiment with features for increasing a flow of air through one of the primary and secondary air plenums which may be used to allow for heating mode operation, higher secondary air flow when high latent loads are present and other operational modes.

FIG. 12 shows a chilled beam embodiment with features for increasing a flow of air through one of the primary and secondary air plenums which may be used to allow for heating mode operation, higher secondary air flow when high latent loads are present and other operational modes. A chilled beam 400 has a secondary air plenum 404 and a primary air plenum 422 which may be generally configured as described in the prior embodiment of FIGS. 10 and 11 with a segmented configuration of the secondary air plenum 404 and supply through a manifold. Alternatively a single continuous plenum configuration for the secondary air plenum 404 may be provided. Flow regulators 402 permit air to be selectively passed into secondary discharge channels 410 from the secondary air plenum 404. Air from a chilled beam system supplies primary and secondary air through respective inlets, an example of one inlet being shown at 420. The inlets may be placed at any location that is suitable for pressurizing the respective plenum. Air from the primary air plenum 422 and the secondary air plenum 404 form respective jets 425 and 424 according to features and principles described already in connection with other embodiments. Flow control devices such as 120 (FIGS. 6, 7 and specific embodiments as in FIG. 7A, for example) may be provided for regulating the jets. It will be evident that symmetrical mixing chambers induce flow through a heat exchanger 418. To produce a final mixed flow through discharge channels 408. The flow regulators 402 allow air to be selectively discharged into discharge channels 402. This function may be used to provide various functions. For example, the chilled beam 400 may be used as a mixing register for heating by discharging heated air from a terminal unit or central unit and supplied to the secondary air plenum 404. The flow regulators 402 may be opened to discharge through the discharge channel 410. The rate of flow may be increased during heating to permit mixing. In another function, for example, air may be discharged through discharge channels 410 when a high capacity and high flow rate are provided by terminal unit for cooling or heating with the terminal unit controlled for variable volume in this case. This may be beneficial for applications where a normal load is substantially below peaks and peaks are relatively rare.

Although symmetrical chilled beam embodiments are described, any of these may be modified as to by asymmetrical design such as used near a wall of an occupied space or to provide asymmetric directional flow.

Figure 13:
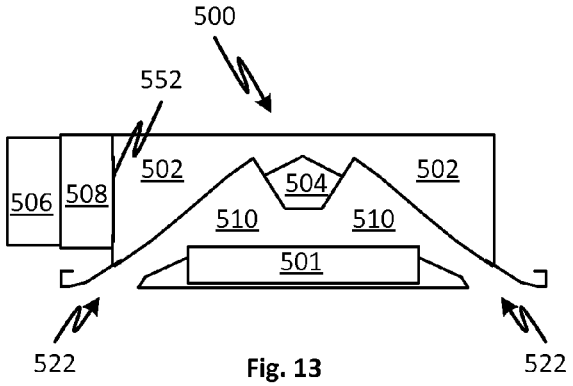
FIG. 13 shows a chilled beam embodiment with features for modulating a flow of secondary air.

FIG. 13 shows a cross-section view of a chilled beam 500 according to embodiments of the disclosed subject matter. The embodiment 500 illustrates features and implementation aspects that provide manufacturability and performance benefits. The chilled beam 500 receives secondary air through a return air collar 506 connected to convey the return air to a manifold plenum 508. Air in the manifold plenum 508 flows through openings (e.g., 326A, 326B, 326C, and 326D in FIG. 11) into secondary air plenums 502 which may be segmented as described with reference to FIGS. 10 and 11 and elsewhere. The return air pressurizes the return air plenum 502 and flows through openings to create jets of return air that run along the length of the return air plenum 502 and are injected into a mixing chamber 510. This induces flow in the mixing chamber to induce room air through a heat exchanger 501 for induced return air. Supply air pressurizes the supply air plenum 504 to create jets of supply air that run along the length of the supply air plenum 504 and are injected into the mixing chamber 510, also to induce room air through the heat exchanger 501. The induction process in other respects is essentially the same as for active chilled beams with the heat exchange performing cooling and also, in some systems and at certain times, in variations, heating. The heat exchanger 501 may be supplied with hot or cold heat transfer fluid. In the present embodiment, a damper blade 552 is shown which may be configured as described with reference to FIGS. 7A and 7B, the damper blade 552 corresponding to, for example, damper blade 208.

Figure 14:
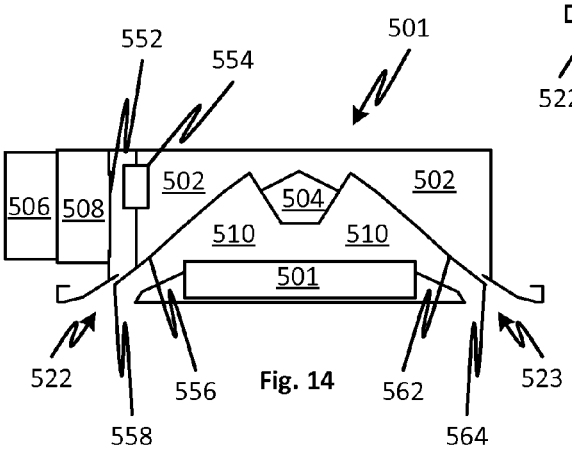
FIG. 14 shows a chilled beam embodiment with further features for modulating a flow of secondary air.

Referring to FIG. 14, an embodiment that is similar to that of FIG. 13 also shows a feature which may be applied to any of the embodiments, namely, a selectable secondary air discharge slot 522. A flexible panel 556 is selectively opened by an actuator 554 to discharge secondary air through a discharge slot 522. Although the feature appears on only one side it can be used on both sides of a symmetrical chilled beam as chilled beam 501. The embodiment also shows an alternative in which a flexible panel 562 passively opens to form a secondary air discharge slot 523 as a result of increased pressure in the secondary air plenum. Although the feature appears on only one side it can be used on both sides of a symmetrical chilled beam as in chilled beam 501 or in combination with the active panel 556 embodiment with the actuator 554.

Figure 15:
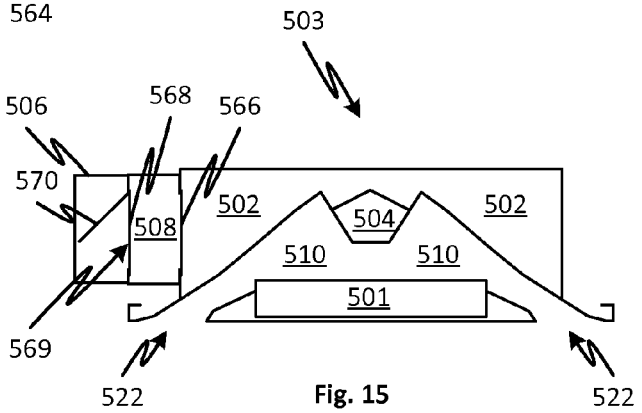
FIG. 15 shows a chilled beam embodiment with features for outputting secondary air selectively through a secondary diffuser.

Referring now to FIG. 15, an embodiment that is similar to that of FIG. 13 also shows a feature which may be applied to any of the embodiments, namely, a secondary discharge 569 which may be closed or opened by a blade damper 568. A deflector 570 extends from a side adjacent the secondary air plenum 508 to deflect secondary air downwardly. This feature may be used to allow the terminal unit or central unit to employ the chilled beam, at times, as a mixing register or for other functions as discussed with reference to the chilled beam 400 in FIG. 12 (i.e., discharge channel 410). In addition, the mixing register function may supplement chilled beam operation according to the disclosed embodiments.

The supplemental discharge features of the embodiments of FIGS. 12-15 may applied to chilled beams having only a secondary inlet (i.e., conventional active chilled beams). Thus, a conventional beam may function as a mixing register for high capacity output by the terminal unit or the central unit.

In any of the embodiments, the chilled beams may be provided in a system for a conditioned space. The system may include central unit configured to convey primary air from a central air handling unit to the primary air inlet of a chilled beam. The terminal unit may be configured to convey conditioned return air to the primary air inlet of the chilled beam or to a secondary air inlet of chilled beam embodiments that possess them. The conditioned return air may be cooled by the terminal unit. The cooled result may be provided by the terminal unit to the chilled beams. The terminal unit may be configured to mix the result in the terminal unit with the primary air from the central air handling unit to produce a combined primary air stream, and provide it to the primary air inlet of the chilled beam. This may be done for embodiments of chilled beams with a single inlet for primary air.

The primary air from the central air handling unit may include a mechanism for conveying primary air at a quality and rate that is sufficient to satisfy a ventilation load of the conditioned space but insufficient to supply a design thermal load requirement. The terminal unit may include a condensing cooling coil configured to reduce the moisture content of the return air. The terminal unit may include a desiccant component configured to reduce the moisture content of the return air.

In embodiments, the disclosed subject matter includes a method of satisfying the load of a conditioned space. The method includes creating a flow of primary air from a central air handling unit. The air handling unit provides fresh air from outside a building and optionally, recirculated air in selectable ratios. The method further includes conveying the primary air from the central air handling unit to a primary inlet of a chilled beam. The embodiment includes supplying secondary air from a terminal unit to a secondary air inlet of a chilled beam. The method further includes generating jets of primary air and secondary air into a mixing chamber and thereby inducing a flow of air from an occupied space through a heat exchanger.

In embodiments, the terminal unit discharges at a first flow rate at first times of low load and at second flow rates at second times of higher load. The chilled beams connected to it, at the second times, reconfigure to define a larger outlet flow area than at the first times, whereby the total flow of secondary air through the chilled beams may be increased without undue restriction at the second times over the first times.

In response to control signals, the chilled beam with primary and secondary jets is reconfigured to increase the effective number of primary jets by changing from a first configuration to a second configuration. The first configuration has a first spacing between pairs of nozzles or subsets of nozzles or a first number of nozzles. The second configuration has a second spacing between pairs or subsets of nozzles or a second number of nozzles. Wherein the second spacing is smaller than the first spacing and the first number is smaller than the first number. The nozzles may be orifices or slot or other arrangements for generating jets.

Chilled beams according to described embodiments receive secondary air through a secondary air collar connected to convey the secondary air to a secondary air plenum. The secondary air pressurizes the secondary air plenum to create jets of secondary air that run along the length of the secondary air plenum and are injected into an induced flow chamber to help in the induction of room air through a heat exchanger via an inlet for induced secondary air. Supply air pressurizes the supply air plenum to create jets of supply air that run along the length of the supply air plenum and are injected into an induced flow chamber to help in the induction of room air through a heat exchanger via an inlet for induced secondary air. The induction process in other respects is essentially the same as for active chilled beams with the heat exchange performing cooling and also, in some systems and at certain times, heating. The heat exchanger may be supplied with hot or cold heat transfer fluid.

In embodiments, the secondary air jets and/or the supply air jets can be closed or the volume of air varied under control of a control system. This may be done using air valves located at the nozzles of the secondary and primary air jets (for example, gang sliding shutter dampers). The dampers may extend to create zones along the lengths of one or more beams permitting independent control of the relative conditioning amounts supplied to different areas of a single space. Alternatively dampers may be employed in place of the ports to regulate the amount of air flowing into each secondary air plenum chamber.

A variant of the system described in the Appendix I is one in which an operating mode of the terminal unit supplying secondary and ventilation air to the beams provides separate secondary and primary air.

The secondary air plenums and primary air plenums may be separated into multiple plenums in the longitudinal direction.

In a control scheme, the primary ventilation air is supplied at a constant rate or is controlled according to occupancy-based control (scheduled or otherwise predictive or feedback-control based on detected load—e.g., temperature—or occupancy or other parameter.

The secondary air may be provided by a zone unit which filters air and conditions it. For example, the zone unit may cool/dehumidify air according to the needs of each zone. Secondary air may be controlled by the zone unit according to need of every room or each beam. Primary air may be delivered by a central air handling unit (AHU).

According to first embodiments, the disclosed subject matter includes a chilled beam device. The device has a longitudinal primary air plenum and at least one longitudinal return air plenum, the primary air and return air plenums is forming an elongate unitary terminal unit, the longitudinal primary air plenum and the longitudinal return air plenum has separate attachment collars for connection to separate air sources to pressurize said primary air plenum and said return air plenum to respective pressures. A heat exchanger is in an air path defined adjacent the terminal unit, the air path including a mixing channel adjacent unitary terminal unit. Each of the primary air and return air plenums open adjacent each other into the mixing channel by means of orifices or nozzles configured to form jets that induce a flow of air through the heat exchanger as well as projecting air away from the unitary terminal unit.

Any of the first embodiments may be modified, where possible, to form additional first embodiments in which the return air plenum is divided into multiple plenum portions each opening to one or more respective ones of the openings or nozzles.

Any of the first embodiments may be modified, where possible, to form additional first embodiments in which the attachment collar for the return air plenum is connected to a manifold that opens by connecting registers to respective portions of the return air plenum.

Any of the first embodiments may be modified, where possible, to form additional first embodiments in which a least some the connecting registers have adjustable open areas to permit the relative amount of air from the manifold to each respective portion of the return air plenum to be adjusted independently.

Any of the first embodiments may be modified, where possible, to form additional first embodiments in which at least one of the connecting registers has a motorized damper.

Any of the first embodiments may be modified, where possible, to form additional first embodiments in which at least two of the connecting registers have motorized dampers.

Any of the first embodiments may be modified, where possible, to form additional first embodiments in which the manifold includes a plenum running a length of the elongate unitary terminal unit.

According to second embodiments, the disclosed subject matter includes a chilled beam device. A primary air plenum and at least one return air plenum define a terminal unit. The primary air plenum and the return air plenum have separate attachment collars for connection to separate air sources to pressurize said primary air plenum and said return air plenum to respective pressures. At least one heat exchanger is in an air path defined adjacent the terminal unit, the air path including a mixing channel adjacent terminal unit. Each of the primary air and return air plenums open adjacent each other into the mixing channel by means of orifices or nozzles configured to form jets that induce a flow of air through the heat exchanger as well as projecting air away from the terminal unit.

Any of the second embodiments may be modified, where possible, to form additional second embodiments in which the return air plenum is divided into multiple plenum portions each opening to one or more respective ones of the openings or nozzles.

Any of the second embodiments may be modified, where possible, to form additional second embodiments in which the attachment collar for the return air plenum is connected to a manifold that opens by connecting registers to respective portions of the return air plenum.

Any of the second embodiments may be modified, where possible, to form additional second embodiments in which a least some the connecting registers have adjustable open areas to permit the relative amount of air from the manifold to each respective portion of the return air plenum to be adjusted independently.

Any of the second embodiments may be modified, where possible, to form additional second embodiments in which at least one of the connecting registers has a motorized damper.

Any of the second embodiments may be modified, where possible, to form additional second embodiments in which at least two of the connecting registers have motorized dampers.

Any of the second embodiments may be modified, where possible, to form additional second embodiments in which the manifold includes a plenum running a length of the elongate unitary terminal unit.

According to third embodiments, the disclosed subject matter includes a chilled beam system with a plurality of chilled beam terminal units, each has a primary air plenum and a return air plenum connected to respective primary and return air ducts. Each chilled beam terminal unit is configured with at least one heat exchanger in an air path defined adjacent the terminal unit, the air path including a mixing channel adjacent terminal unit. Each of the primary air and return air plenums opens into the mixing channel by means of orifices or nozzles configured to form jets that induce a flow of air through the heat exchanger as well as projecting air away from the terminal unit. An air handling unit is configured to convey primary air, including ventilation air, to each of the terminal unit primary air plenums. An air conditioning is unit configured to receive return air, condition the return air, and supply resulting conditioned return air to the terminal unit return air plenums.

Any of the third embodiments may be modified, where possible, to form additional third embodiments in which the return air plenum is divided into multiple plenum portions each opening to one or more respective ones of the openings or nozzles.

Any of the third embodiments may be modified, where possible, to form additional third embodiments in which the attachment collar for the return air plenum is connected to a manifold that opens by connecting registers to respective portions of the return air plenum.

Any of the third embodiments may be modified, where possible, to form additional third embodiments in which a least some the connecting registers have adjustable open areas to permit the relative amount of air from the manifold to each respective portion of the return air plenum to be adjusted independently.

Any of the third embodiments may be modified, where possible, to form additional third embodiments in which at least one of the connecting registers has a motorized damper.

Any of the third embodiments may be modified, where possible, to form additional third embodiments in which at least two of the connecting registers have motorized dampers.

Any of the third embodiments may be modified, where possible, to form additional third embodiments in which the manifold includes a plenum running a length of the terminal unit.

According to fourth embodiments, the disclosed subject matter includes an air terminal device with separate primary and secondary air chambers each has several nozzles or openings through which air is conducted into a mixing channel, each of the primary and secondary air chambers has respective inlet connections for connection to respective sources of air. The air terminal device includes a heat exchanger and a flow aperture on one or both sides of the air terminal device through which recirculated air flows, induced by the flow of primary and secondary air from the several nozzles or openings, and flowing through the heat exchanger.

Any of the fourth embodiments may be modified, where possible, to form additional fourth embodiments in which the mixing channel opens through a slot into an occupied space.

Any of the fourth embodiments may be modified, where possible, to form additional fourth embodiments in which the mixing channel forms a directional nozzle that is aimed partly downwardly.

Any of the fourth embodiments may be modified, where possible, to form additional fourth embodiments in which the mixing channel forms a directional nozzle that is aimed partly horizontally.

Any of the fourth embodiments may be modified, where possible, to form additional fourth embodiments that include a damper configured to regulate flow through said secondary air chamber inlet.

Any of the fourth embodiments may be modified, where possible, to form additional fourth embodiments in which air flow rate through the secondary air chamber nozzles is selectively variable by at least one mechanism that varies a flow area therethrough.

Any of the fourth embodiments may be modified, where possible, to form additional fourth embodiments in which air flow rate through the secondary air chamber nozzles is selectively variable by at least one mechanism that varies a flow area therethrough.

Any of the fourth embodiments may be modified, where possible, to form additional fourth embodiments in which at least the secondary air chamber is divided longitudinally into respective portions which are configured to be fed with air through a common manifold connected to said respective inlet connection.

Any of the fourth embodiments may be modified, where possible, to form additional fourth embodiments in which the common manifold is connected to each of the respective second air chamber respective portions through a damper that can close progressively and selectively to permit the quantity of air to be selectively apportioned among said respective second air chamber respective portions.

Any of the fourth embodiments may be modified, where possible, to form additional fourth embodiments in which the manifold is a duct spanning a length of the air terminal device, the manifold, and primary and secondary air chambers is elongate and generally parallel in configuration with the manifold forming a continuous plenum.

Any of the fourth embodiments may be modified, where possible, to form additional fourth embodiments in which the manifold is adjacent the secondary chamber with the dampers positioned between the respective second air chambers and the manifold.

Any of the fourth embodiments may be modified, where possible, to form additional fourth embodiments in which the dampers are motorized.

Any of the fourth embodiments may be modified, where possible, to form additional fourth embodiments in which the dampers are movable independently so that air flow through said respective portions can be varied along a length of the air terminal device.

Any of the fourth embodiments may be modified, where possible, to form additional fourth embodiments in which the primary and secondary air chambers are elongate enclosures.

Any of the fourth embodiments may be modified, where possible, to form additional fourth embodiments in which at least the secondary air chamber is divided longitudinally into respective portions which are configured to be fed with air through a common manifold connected to said respective inlet connection.

Any of the fourth embodiments may be modified, where possible, to form additional fourth embodiments in which the common manifold is connected to each of the respective second air chamber respective portions through a damper that can adjusted to permit adjustment of the quantity of air supplied to said respective second air chamber respective portions.

Any of the fourth embodiments may be modified, where possible, to form additional fourth embodiments in which the manifold is a duct spanning a length of the air terminal device, the manifold, and primary and secondary air chambers is elongate and generally parallel in configuration with the manifold forming a continuous plenum.

Any of the fourth embodiments may be modified, where possible, to form additional fourth embodiments in which the manifold is adjacent the secondary chamber with the dampers positioned between the respective second air chambers and the manifold.

Any of the fourth embodiments may be modified, where possible, to form additional fourth embodiments in which the dampers are motorized.

Any of the fourth embodiments may be modified, where possible, to form additional fourth embodiments in which the dampers are movable independently so that air flow through said respective portions can be varied along a length of the air terminal device.

Any of the fourth embodiments may be modified, where possible, to form additional fourth embodiments in which the common manifold is connected to each of the respective second air chamber respective portions through a damper that can close progressively and selectively to permit the quantity of air to be selectively apportioned among said respective second air chamber respective portions.

Any of the fourth embodiments may be modified, where possible, to form additional fourth embodiments in which the manifold is a duct spanning a length of the air terminal device, the manifold, and primary and secondary air chambers is elongate and generally parallel in configuration with the manifold forming a continuous plenum.

Any of the fourth embodiments may be modified, where possible, to form additional fourth embodiments in which the manifold is adjacent the secondary chamber with the dampers positioned between the respective second air chambers and the manifold.

Any of the fourth embodiments may be modified, where possible, to form additional fourth embodiments in which the dampers are motorized.

Any of the fourth embodiments may be modified, where possible, to form additional fourth embodiments in which the dampers are movable independently so that air flow through said respective portions can be varied along a length of the air terminal device.

According to fifth embodiments, the disclosed subject matter includes a ventilation system with a plurality of air terminal devices. Each air terminal device includes separate primary and secondary air chambers each has several nozzles or openings through which air is conducted into a mixing channel, each of the primary and secondary air chambers having respective inlet connections for connection to respective sources of air. Each also includes a heat exchanger. Each air terminal device includes a flow aperture on one or both sides of the air terminal device through which recirculated air flows, induced by the flow of primary and secondary air from the several nozzles or openings, and flowing through the heat exchanger. A central air handling unit is configured to distribute ventilation air through a first duct network, the primary air chamber inlet connection is connected to receive air from the first duct network. One or more distributed recirculation air conditioning units is configured to receive air from respective occupied space and distributed it to one or more respective ones of said secondary air chamber inlet connections.

Any of the fifth embodiments may be modified, where possible, to form additional fifth embodiments in which the mixing channel opens through a slot into an occupied space.

Any of the fifth embodiments may be modified, where possible, to form additional fifth embodiments in which the mixing channel forms a directional nozzle that is aimed partly downwardly.

Any of the fifth embodiments may be modified, where possible, to form additional fifth embodiments in which the mixing channel forms a directional nozzle that is aimed partly horizontally.

Any of the fifth embodiments may be modified, where possible, to form additional fifth embodiments in which air flow rate through the secondary air chamber nozzles is selectively variable by at least one mechanism that varies a flow area therethrough.

Any of the fifth embodiments may be modified, where possible, to form additional fifth embodiments in which air flow rate through the secondary air chamber nozzles is selectively variable by at least one mechanism that varies a flow area therethrough.

Any of the fifth embodiments may be modified, where possible, to form additional fifth embodiments in which the primary and secondary air chambers are elongate enclosures.

Any of the fifth embodiments may be modified, where possible, to form additional fifth embodiments in which at least the secondary air chamber is divided longitudinally into respective portions which are configured to be fed with air through a common manifold connected to said respective inlet connection.

Any of the fifth embodiments may be modified, where possible, to form additional fifth embodiments in which the common manifold is connected to each of the respective second air chamber respective portions through a damper that can close progressively and selectively to permit the quantity of air to be selectively apportioned among said respective second air chamber respective portions.

Any of the fifth embodiments may be modified, where possible, to form additional fifth embodiments in which the manifold is a duct spanning a length of the air terminal device, the manifold, and primary and secondary air chambers is elongate and generally parallel in configuration with the manifold forming a continuous plenum.

Any of the fifth embodiments may be modified, where possible, to form additional fifth embodiments in which the manifold is adjacent the secondary chamber with the dampers positioned between the respective second air chambers and the manifold.

Any of the fifth embodiments may be modified, where possible, to form additional fifth embodiments in which the dampers are motorized.

Any of the fifth embodiments may be modified, where possible, to form additional fifth embodiments in which the dampers are movable independently so that air flow through said respective portions can be varied along a length of the air terminal device.

Any of the fifth embodiments may be modified, where possible, to form additional fifth embodiments in which the primary and secondary air chambers are elongate enclosures.

Any of the fifth embodiments may be modified, where possible, to form additional fifth embodiments in which at least the secondary air chamber is divided longitudinally into respective portions which are configured to be fed with air through a common manifold connected to said respective inlet connection.

Any of the fifth embodiments may be modified, where possible, to form additional fifth embodiments in which the common manifold is connected to each of the respective second air chamber respective portions through a damper that can adjusted to permit adjustment of the quantity of air supplied to said respective second air chamber respective portions.

Any of the fifth embodiments may be modified, where possible, to form additional fifth embodiments in which the manifold is a duct spanning a length of the air terminal device, the manifold, and primary and secondary air chambers is elongate and generally parallel in configuration with the manifold forming a continuous plenum.

Any of the fifth embodiments may be modified, where possible, to form additional fifth embodiments in which the manifold is adjacent the secondary chamber with the dampers positioned between the respective second air chambers and the manifold.

Any of the fifth embodiments may be modified, where possible, to form additional fifth embodiments in which the dampers are motorized.

Any of the fifth embodiments may be modified, where possible, to form additional fifth embodiments in which the dampers are movable independently so that air flow through said respective portions can be varied along a length of the air terminal device.

Any of the fifth embodiments may be modified, where possible, to form additional fifth embodiments in which the common manifold is connected to each of the respective second air chamber respective portions through a damper that can close progressively and selectively to permit the quantity of air to be selectively apportioned among said respective second air chamber respective portions.

Any of the fifth embodiments may be modified, where possible, to form additional fifth embodiments in which the manifold is a duct spanning a length of the air terminal device, the manifold, and primary and secondary air chambers is elongate and generally parallel in configuration with the manifold forming a continuous plenum.

Any of the fifth embodiments may be modified, where possible, to form additional fifth embodiments in which the manifold is adjacent the secondary chamber with the dampers positioned between the respective second air chambers and the manifold.

Any of the fifth embodiments may be modified, where possible, to form additional fifth embodiments in which wherein the dampers are motorized.

Any of the fifth embodiments may be modified, where possible, to form additional fifth embodiments in which wherein the dampers are movable independently so that air flow through said respective portions can be varied along a length of the air terminal device.

According to sixth embodiments, the disclosed subject matter includes a method of cooling an occupied space. The method includes detecting a load in an occupied space in which a chilled beam provides cooling. The chilled beam provides sensible cooling using primary air from a central unit. In response to the detecting, the method calls for supplying a first amount of secondary air to generate jets in a first portion of the mixing chamber of the chilled beam to induce higher flow through a first portion of the heat exchanger of the chilled beam.

Any of the sixth embodiments may be modified, where possible, to form additional sixth embodiments in which the chilled beam has separate plenums for primary and secondary air.

Any of the sixth embodiments may be modified, where possible, to form additional sixth embodiments in which the plenum for secondary air receives recirculating air from a source separate form said primary air.

Any of the sixth embodiments may be modified, where possible, to form additional sixth embodiments in which said plenum for said secondary air is separated into separate portions.

Any of the sixth embodiments may be modified, where possible, to form additional sixth embodiments in which said plenum for said secondary air is separated longitudinally into first and second separate portions.

Any of the sixth embodiments may be modified, where possible, to form additional sixth embodiments in which the first amount is generated with air from the secondary air plenum first portion.

Any of the sixth embodiments may be modified, where possible, to form additional sixth embodiments that include in response to the detecting, supplying a second amount of secondary air to generate jets in a second portion of the mixing chamber of the chilled beam to induce higher flow through a second portion of the heat exchanger of the chilled beam.

Any of the sixth embodiments may be modified, where possible, to form additional sixth embodiments in which the first amount is generated with air from the secondary air plenum second portion.

According to seventh embodiments, the disclosed subject matter includes a chilled beam device with a primary air plenum with primary jet openings along a longitudinal aspect thereof configured for primary generating jets from air in said primary air plenum. A secondary air plenum is divided into segments, each having secondary jet openings along a longitudinal aspect thereof configured for generating secondary jets from air in said secondary air plenum, where the segments are sealed from each other such that pressure in one does not affect the pressure in another. The secondary jets openings include first secondary jet openings that open to a first of said segments and second secondary openings that open to a second of said segments. The secondary plenum has a flow regulation portion that is configured to deliver selected volumes of air to each of said first and second segments, responsively to a controller.

Any of the seventh embodiments may be modified, where possible, to form additional seventh embodiments in which the flow regulation portion includes a damper.

Any of the seventh embodiments may be modified, where possible, to form additional seventh embodiments in which the flow regulation portion is configured to deliver air from a secondary inlet to the first segment at a first configuration thereof and to deliver air from the secondary inlet to the second segment at a second configuration thereof.

Any of the seventh embodiments may be modified, where possible, to form additional seventh embodiments in which, when the flow regulation device is in the first configuration, the air flows into only the first of segments.

Any of the seventh embodiments may be modified, where possible, to form additional seventh embodiments in which, when the flow regulation device is in the first configuration, the air flows into the first and second of the segments.

Any of the seventh embodiments may be modified, where possible, to form additional seventh embodiments in which the flow regulation device includes a manifold that distributes air along a length of the chilled beam device.

Any of the seventh embodiments may be modified, where possible, to form additional seventh embodiments in which, when the flow regulator is in the first configuration, the first secondary jet openings receive air and induce an additional flow in a first portion of the heat exchanger.

In all of the foregoing embodiments, although jets were shown to be generated using orifices, it is possible to generate jets using slots, diffusers, nozzles or other known flow arrangements. Disclosed embodiments may be modified to use such alternative jet generators. In the foregoing embodiments, certain types of flow regulators were described. It will be evident in many cases that substitutions to these may be made, for example, damper blades can be replaced with other types of flow regulators, such as louvers, irises, and others.

As used herein, a terminal unit is in a hierarchical relationship below a central unit and above chilled beams served by the terminal unit. Thus one central unit may supply primary air (which includes ventilation air) to multiple terminal units and each terminal unit supplies air to a set of chilled beams, which subset is a fraction of the chilled beams served by the one central unit. A building may have more than one central unit but the hierarchy is assumed for each one. Primary air refers to ventilation (fresh) air and may include recirculating conditioned air or unconditioned recirculated air. Secondary air refers to air drawn from the occupied space (recirculated) and may include a fresh air from the central unit.

So primary air is distinguished from secondary air in that they come from two different sources. In embodiments, primary air comes from the central unit and secondary air from a terminal unit. In other embodiments, primary air comes from the central unit and secondary air comes from a fan unit local to one or more chilled beams which draws air directly from the occupied space. Note that in any of the embodiments, the fan units directly associated with a chilled beam unit (which may be interconnected end to end unitary machines to form a single chilled beam unit) may include air treatment components such as air filters or any other kind of air treatment device.

It will be appreciated that the modules, processes, systems, and sections described above can be implemented in hardware, hardware programmed by software, software instruction stored on a non-transitory computer readable medium or a combination of the above. For example, a method for controlling ventilation systems can be implemented, for example, using a processor configured to execute a sequence of programmed instructions stored on a non-transitory computer readable medium. For example, the processor can include, but not be limited to, a personal computer or workstation or other such computing system that includes a processor, microprocessor, microcontroller device, or is comprised of control logic including integrated circuits such as, for example, an Application Specific Integrated Circuit (ASIC). The instructions can be compiled from source code instructions provided in accordance with a programming language such as Java, C++, C#.net or the like. The instructions can also comprise code and data objects provided in accordance with, for example, the Visual Basic™ language, LabVIEW, or another structured or object-oriented programming language. The sequence of programmed instructions and data associated therewith can be stored in a non-transitory computer-readable medium such as a computer memory or storage device which may be any suitable memory apparatus, such as, but not limited to read-only memory (ROM), programmable read-only memory (PROM), electrically erasable programmable read-only memory (EEPROM), random-access memory (RAM), flash memory, disk drive and the like.

Furthermore, the modules, processes, systems, and sections can be implemented as a single processor or as a distributed processor. Further, it should be appreciated that the steps mentioned above may be performed on a single or distributed processor (single and/or multi-core). Also, the processes, modules, and sub-modules described in the various figures of and for embodiments above may be distributed across multiple computers or systems or may be co-located in a single processor or system. Exemplary structural embodiment alternatives suitable for implementing the modules, sections, systems, means, or processes described herein are provided below.

The modules, processors or systems described above can be implemented as a programmed general purpose computer, an electronic device programmed with microcode, a hard-wired analog logic circuit, software stored on a computer-readable medium or signal, an optical computing device, a networked system of electronic and/or optical devices, a special purpose computing device, an integrated circuit device, a semiconductor chip, and a software module or object stored on a computer-readable medium or signal, for example.

Embodiments of the method and system (or their subcomponents or modules), may be implemented on a general-purpose computer, a special-purpose computer, a programmed microprocessor or microcontroller and peripheral integrated circuit element, an ASIC or other integrated circuit, a digital signal processor, a hardwired electronic or logic circuit such as a discrete element circuit, a programmed logic circuit such as a programmable logic device (PLD), programmable logic array (PLA), field-programmable gate array (FPGA), programmable array logic (PAL) device, or the like. In general, any process capable of implementing the functions or steps described herein can be used to implement embodiments of the method, system, or a computer program product (software program stored on a non-transitory computer readable medium).

Furthermore, embodiments of the disclosed method, system, and computer program product may be readily implemented, fully or partially, in software using, for example, object or object-oriented software development environments that provide portable source code that can be used on a variety of computer platforms. Alternatively, embodiments of the disclosed method, system, and computer program product can be implemented partially or fully in hardware using, for example, standard logic circuits or a very-large-scale integration (VLSI) design. Other hardware or software can be used to implement embodiments depending on the speed and/or efficiency requirements of the systems, the particular function, and/or particular software or hardware system, microprocessor, or microcomputer being utilized. Embodiments of the method, system, and computer program product can be implemented in hardware and/or software using any known or later developed systems or structures, devices and/or software by those of ordinary skill in the applicable art from the function description provided herein and with a general basic knowledge of ventilation system, control systems, and/or computer programming arts.

Moreover, embodiments of the disclosed method, system, and computer program product can be implemented in software executed on a programmed general purpose computer, a special purpose computer, a microprocessor, or the like.

It is, thus, apparent that there is provided, in accordance with the present disclosure, devices, methods, and systems for chilled beams and similar terminal units. Many alternatives, modifications, and variations are enabled by the present disclosure. Features of the disclosed embodiments can be combined, rearranged, omitted, etc., within the scope of the invention to produce additional embodiments. Furthermore, certain features may sometimes be used to advantage without a corresponding use of other features. Accordingly, Applicants intend to embrace all such alternatives, modifications, equivalents, and variations that are within the spirit and scope of the present invention.

The invention claimed is:

1. A chilled beam device, comprising:

an elongate primary air plenum extending in a longitudinal direction and at least one elongate return air plenum extending in the longitudinal direction, the elongate primary air plenum and the at least one elongate return air plenum forming an elongate unitary terminal unit with outlet vents opening directly into a room, the elongate primary air plenum and the at least one elongate return air plenum having separate attachment collars for connection to separate air sources to pressurize said elongate primary air plenum and said elongate return air plenum to respective pressures;

a heat exchanger in an air path defined adjacent the elongate unitary terminal unit, the air path including a mixing channel adjacent the elongate unitary terminal unit, wherein each of the elongate primary air plenum and the at least one elongate return air plenum open adjacent each other into the mixing channel via orifices or nozzles configured to form jets from each of the elongate primary air plenum and the at least one elongate return air plenum that induce a flow of air from the room through the heat exchanger as well as projecting air away from the unitary terminal unit directly into the room through the outlet vents.

2. The device of claim 1, wherein the at least one elongate return air plenum is divided into multiple plenum portions each opening to one or more respective ones of the openings or nozzles.

3. The device of claim 1, further comprising:

a manifold interconnecting the attachment collar and the at least one return air plenum, the manifold including connecting registers that open to respective portions of the at least one elongate return air plenum.

4. The device of claim 3, wherein a least some the connecting registers have adjustable open areas to permit a relative amount of air from the manifold to each respective portion of the at least one elongate return air plenum to be adjusted independently.

5. The device of claim 4, wherein at least one of the connecting registers has a motorized damper.

6. The device of claim 4, wherein at least two of the connecting registers have motorized dampers.

7. The device of claim 6, wherein the manifold includes a plenum running a length of the elongate unitary terminal unit.

8. The device of claim 5, wherein the manifold includes a plenum running a length of the elongate unitary terminal unit.

9. A chilled beam device, comprising:

a primary air plenum and at least one return air plenum, the primary air and return air plenums defining a terminal unit, the primary air plenum and the return air plenum having separate attachment collars for connection to separate air sources to pressurize said primary air plenum and said return air plenum to respective pressures;

at least one heat exchanger in an air path defined adjacent the terminal unit, the air path including a mixing channel adjacent terminal unit;

each of the primary air and return air plenums opening adjacent each other into the mixing channel by means of orifices or nozzles configured to form jets that induce a flow of air through the heat exchanger as well as projecting air away from the terminal unit.

10. The device of claim 9, wherein the return air plenum is divided into multiple plenum portions each opening to one or more respective ones of the openings or nozzles.

11. The device of claim 9, further comprising:

a manifold interconnecting the attachment collar and the at least one return air plenum, the manifold including connecting registers that open to respective portions of the at least one return air plenum.

12. The device of claim 11, wherein a least some the connecting registers have adjustable open areas to permit the relative amount of air from the manifold to each respective portion of the return air plenum to be adjusted independently.

13. The device of claim 12, wherein at least one of the connecting registers has a motorized damper.

14. The device of claim 13, wherein at least two of the connecting registers have motorized dampers.

15. The device of claim 14, wherein the manifold includes a plenum running a length of the elongate unitary terminal unit.

16. The device of claim 15, wherein the manifold includes a plenum running a length of the terminal unit.

17. A chilled beam system, comprising:

a plurality of chilled beam terminal units, each having a primary air plenum and a return air plenum connected to respective primary and return air ducts;

each chilled beam terminal unit being configured with at least one heat exchanger in an air path defined adjacent the terminal unit, the air path including a mixing channel adjacent terminal unit;

each of the primary air and return air plenums opening into the mixing channel by means of orifices or nozzles configured to form jets that induce a flow of air through the heat exchanger as well as projecting air away from the terminal unit;

an air handling unit configured to convey primary air, including ventilation air, to each of the terminal unit primary air plenums;

an air conditioning unit configured to receive return air, condition the return air, and supply resulting conditioned return air to the terminal unit return air plenums.

18. The system of claim 17, wherein the return air plenum is divided into multiple plenum portions each opening to one or more respective ones of the openings or nozzles.

19. The system of claim 17, further comprising:

at least one manifold interconnecting the attachment collar and at least one return air plenum, the manifold including connecting registers that open to respective portions of the at least one return air plenum.

20. The system of claim 19, wherein a least some the connecting registers have adjustable open areas to permit the relative amount of air from the manifold to each respective portion of the return air plenum to be adjusted independently.

21. The system of claim 20, wherein at least one of the connecting registers has a motorized damper.

22. The system of claim 21, wherein at least two of the connecting registers have motorized dampers.

23. The system of claim 22, wherein the manifold includes a plenum running a length of the at least one return air plenum.

24. The system of claim 23, wherein the manifold includes a plenum running a length of the terminal unit.

* * * * *